US011772948B2

(12) United States Patent
Bailey

(10) Patent No.: US 11,772,948 B2
(45) Date of Patent: Oct. 3, 2023

(54) CONTROLLER

(71) Applicant: J. C. Bamford Excavators Limited, Uttoxeter (GB)

(72) Inventor: Jonathan Kenred Bailey, Uttoxeter (GB)

( * ) Notice: Subject to any disclaimer, the term of this patent is extended or adjusted under 35 U.S.C. 154(b) by 165 days.

(21) Appl. No.: 17/211,793

(22) Filed: Mar. 24, 2021

(65) Prior Publication Data

US 2021/0300744 A1 Sep. 30, 2021

(30) Foreign Application Priority Data

Mar. 31, 2020 (GB) ..... 2004691

(51) Int. Cl.
*B66F 17/00* (2006.01)
*B66F 9/075* (2006.01)
*B66F 9/065* (2006.01)

(52) U.S. Cl.
CPC ..... *B66F 17/003* (2013.01); *B66F 9/065* (2013.01); *B66F 9/0755* (2013.01); *B66F 9/07559* (2013.01)

(58) Field of Classification Search
CPC ..... B66F 17/003; B66F 9/065; B66F 9/0755; B66F 9/07559; B66F 9/0655; E02F 3/3402; E02F 3/431; E02F 9/085; E02F 9/2033; E02F 9/265
See application file for complete search history.

(56) References Cited

U.S. PATENT DOCUMENTS 5,639,119 A * 6/1997 Plate ..... B62D 49/08 280/124.112
5,997,013 A 12/1999 Claxton
6,175,796 B1 * 1/2001 Ishikawa ..... B66F 17/003 280/755

(Continued)

FOREIGN PATENT DOCUMENTS

EP 2544985 A1 1/2013
GB 2560328 A 9/2018

OTHER PUBLICATIONS

Search Report for GB 2004691.8, dated Sep. 10, 2020.

(Continued)

*Primary Examiner* — Tyler J Lee
*Assistant Examiner* — Yufeng Zhang
(74) *Attorney, Agent, or Firm* — MARSHALL, GERSTEIN & BORUN LLP

(57) ABSTRACT

A controller for use with a working machine includes a machine body and a load handling apparatus coupled to the machine body and moveable by a lift actuator and a sway actuator. The controller receives a signal representative of the position of the load handling apparatus and a signal representative of a stability of the working machine. The controller determines a movement range of the load handling apparatus about the sway axis and issues a signal for use by an element of the working machine. The controller restricts or prevents movement of the load handling apparatus outside of the permissible movement range relative to the lateral reference orientation, the permissible range being dependent on the signal representative of the position of the load handling apparatus with respect to the machine body or longitudinal reference orientation and the signal representative of the stability of the machine.

25 Claims, 10 Drawing Sheets

(56) References Cited

U.S. PATENT DOCUMENTS

| | | | | |
|---|---|---|---|---|
| 6,302,419 | B1 * | 10/2001 | Ito | B66F 9/07568 280/755 |
| 2002/0002431 | A1 | 1/2002 | Panizzolo | |
| 2004/0131458 | A1 | 7/2004 | Litchfield et al. | |
| 2007/0059146 | A1 | 3/2007 | Bitter | |
| 2009/0020965 | A1 * | 1/2009 | North | B66F 9/0655 414/815 |
| 2017/0291802 | A1 | 10/2017 | Hao et al. | |

OTHER PUBLICATIONS

Extended European Search Report for European Patent Application No. 21165788.7, dated Jan. 24, 2022.
Communication Pursuant to Rule 114(2) EPC, dated Jun. 22, 2022.

* cited by examiner

CONTROLLER

FIELD

The present teachings relate to a controller for use with a working machine, and in particular to a controller for maintaining stability of a working machine.

BACKGROUND

Working machines are often used in construction, agriculture and other industries to perform tasks that humans are unable to do or to perform tasks more quickly than a human. Examples of working machines include, but are not limited to, excavators, backhoe loaders, telescopic handlers, tractors, loaders and dumpers.

Many working machines include a movable load handling apparatus such as, for example, a boom comprising a load interacting structure (e.g. forks, a bucket, jaws etc.) for manipulating, transporting and/or excavating a load (e.g. earth, cargo, agricultural produce etc.), hereinafter referred to as an implement. For such working machines, when the load handling apparatus is moved into a position such that the location of the working machine's centre of gravity changes significantly, the working machine may become significantly less laterally stable. For working machines comprising a boom as part of its load handling apparatus, this scenario may occur when the boom is at a high angle relative to a horizontal plane of the working machine. Working machines operable on uneven ground often have one wheel axle that is fixed relative to the body of the working machine and a second axle that may oscillate within limits about a fore-aft axis of the working machine. This enables all four wheels to remain in contact with the ground in normal operating conditions to enhance traction and stability.

It is known in the art for some working machines to include an actuation system that allows the working machine to sway about a longitudinal (fore-aft) axis of the working machine. This may be accomplished by providing the working machine with a first wheel axle that allows the body of the working machine to freely pivot within certain limits with respect to said wheel axle. An extendible hydraulic ram mounted between a second oscillating wheel axle of the working machine and the body may be configured to force the body to sway with respect to both wheel axles, and therefore with respect to the ground beneath the working machine.

The hydraulic ram is of fixed length in normal use, but the ram length may be adjusted in certain situations to align an implement (e.g. pallet forks) with a load to be lifted (e.g. a pallet on a stack or vehicle). Misalignment may occur where the ground upon which the machine stands is uneven with respect to the position of the load. Without this system the machine operator may have to reposition the machine entirely to enable the forks to engage the apertures in the pallet and lift the load. This harms the productivity of the machine.

A swayable working machine may become laterally unstable when the sway angle of the body of the working machine with respect to its wheel axles becomes too large. In such instances, the working machine may roll onto its side, potentially causing injury or worse to the operator of the working machine. This problem may be exacerbated when such a working machine includes a load handling apparatus that is in a position that further reduces the lateral stability of the working machine; for example, a boom at a high angle relative to a horizontal plane of the working machine. Therefore, it is common in the art to enforce a fixed sway interlock that allows such working machines to sway only when the load handling apparatus is at or near a position which maximises the lateral stability of the machine. For example, for swayable working machines comprising a boom, the machine may be only permitted to sway when the boom is less than ten degrees with respect to a horizontal plane of the machine.

Swayable machines that enforce a fixed sway interlock do not account for the effects of the position of the load handling apparatus and the sway angle on the lateral stability of the machine. A fixed sway interlock may prevent a swayable working machine from swaying, even if the state of the machine is such that it is safe to allow the machine to sway through a permissible movement range. For example, for swayable working machines comprising a boom with forks at a free end thereof that are used to load and/or unload pallets from a truck, a fixed sway interlock may prevent the machine from swaying to align the forks with the pallets on the truck in the event that the boom angle is too large. In such a scenario, it may be safe for the working machine to perform such a swaying movement based on its stability state. Hence, a fixed sway interlock may be overly restrictive in many situations. Further, such machine measure sway as the relationship of the machine body to the axle, rather than to the horizontal, and so fail to account for side slopes when considering stability. In addition, such machines use a simple on/off valve to control sway adjustment, and therefore require a greater safety margin to allow for dynamic effects caused by the sway adjustment itself.

The present teachings seek to overcome, or at least mitigate the problems of the prior art.

SUMMARY

According to a first aspect of the present teachings, there is provided a controller for use with a working machine comprising a machine body and a load handling apparatus coupled to the machine body and moveable by a lift actuator with respect to the machine body and moveable by a sway actuator about a sway axis with respect to a transverse reference orientation. The controller is configured to receive: a signal representative of the position of the load handling apparatus with respect to the machine body or a longitudinal reference orientation; and a signal representative of a stability of the working machine. The controller is further configured to determine a permissible movement range of the load handling apparatus about the sway axis and issue a signal for use by an element of the working machine including the sway actuator, which in response to the signal issued by the controller is configured to restrict or prevent movement of the load handling apparatus outside of the permissible movement range relative to the transverse reference orientation, the permissible movement range being dependent on the signal representative of the position of the load handling apparatus with respect to the machine body or longitudinal reference orientation and the signal representative of the stability of the machine.

The controller helps to maintain lateral stability of a working machine by limiting lateral roll (i.e. sway) movement of the working machine's load handling apparatus based on the two signals. Advantageously, the controller may use the two signals to permit a movement range through which the load handling apparatus can rotate about the sway axis that is considered safe dependent on the state and position of the machine. Thus, the controller may help to increase the allowable sway range of a working machine to better enable sway operations; e.g. for stacking and de-stacking operations on uneven ground without adding appreciably to the cost and complexity of the working machine.

The load handling apparatus may comprise a boom, and the signal representative of the position of the load handling apparatus with respect to the machine body may correspond to an angle measurement of the boom with respect to a predetermined plane of the machine body. Alternatively, the signal representative of the position of the load handling apparatus a longitudinal reference orientation may correspond to an angle measurement of the boom with respect to The controller may store parameters representative of a first boom angle and a second boom angle, the first boom angle being lower than the second boom angle, and wherein the permissible movement range may be less at the second boom angle than when the boom is at the first boom angle.

A working machine comprising a boom tends to become more laterally unstable as the angle of the boom increases. Therefore, reducing the permissible movement range as the angle of the boom increases helps to ensure that the working machine remains stable.

The signal representative of the stability of the working machine may correspond to a longitudinal moment of tilt of the working machine.

The controller may store parameters representative of a first moment of tilt and a second moment of tilt of the working machine, the first moment of tilt being lower than the second moment of tilt, and wherein the permissible movement range may be less when the moment of tilt of the working machine corresponds to the first moment of tilt than when the moment of tilt of the working machine corresponds to the second moment of tilt.

A working machine tends to become more laterally stable as its longitudinal moment of tilt increases. This is because the centre of gravity of the working machine is closer to an axle of the working machine that is blocked from swaying which provides a wider base to the stability envelope of the working machine. Therefore, reducing the permissible movement range as the moment of tilt decreases helps to ensure that the working machine remains stable.

The longitudinal moment of tilt of the working machine may correspond to a load measurement of an axle of the working machine, wherein the axle is for mounting a ground-engaging structure thereto such as a pair of ground-engaging wheels.

This allows for a simple determination of the moment of tilt of the working machine.

The controller may receive the permissible movement range from a predetermined look-up table or map, the predetermined look-up table or map configured to output the permissible movement range that ensures stability of the working machine based on inputs of the position of the load handling apparatus with respect to the machine body and the stability of the working machine.

This provides a simple way of optimising the stability characteristics of the working machine to maximise productivity.

The permissible movement range may be obtained by determining a stability envelope for the working machine and a location of the working machine's centre of gravity. The permissible movement range may be chosen such that the working machine's centre of gravity remains in the stability envelope across the whole of the permissible movement range.

This allows a permissible movement range to be chosen that ensures lateral stability of the working machine. Thus, maximising the permissible movement range that provides stable and safe operation of the working machine.

The lateral reference orientation may correspond to a horizontal axis defined such that the direction of acceleration due to gravity is normal to the horizontal plane.

The sway axis may be parallel to a ground plane beneath the working machine during operation.

In response to the signal issued by the controller, the element of the working machine may be configured to implement an upper speed limit such that the load handling apparatus is prevented from moving at rotational speeds higher than the upper speed limit about the sway axis.

This allows the maximum sway speed of a working machine to be chosen that ensures lateral stability of the working machine. Thus, the controller may allow a working machine to sway at higher rotational speeds than in the prior art when it is safe to do so.

The controller may be configured to receive a signal representative of a travelling speed of the working machine, and the permissible movement range may be further dependent on said signal.

The controller may store parameters representative of a first travelling speed and a second travelling speed, the first travelling speed being lower than the second travelling speed, and wherein the permissible movement range may be less at the second travelling speed than at the first travelling speed.

A greater risk of lateral instability arising occurs as the forward speed of a working machine increases. Therefore, reducing the permissible movement range as the forward speed increases helps to ensure that the working machine remains stable.

The controller may be further configured to issue a signal for use by an operator interface such as a display or an audible alert, which in response to said signal is configured to provide an indication of the permissible movement range.

This allows an operator of the working machine to know when it is safe to change the sway angle of the working machine, and potentially by how much they can change the sway angle of the working machine.

The controller may be further configured to issue a signal for use by the element of the working machine, which in response to said signal is configured to move the load handling apparatus about the swivel axis to a desired position within the permissible movement range.

This allows the controller to automatically change the sway angle of the working machine to a given angle (e.g. an angle specified by the operator of the working machine). Advantageously, the controller may change the sway angle such that the load handling apparatus is level with a vehicle or platform to which it is loading or unloading cargo.

The working machine may further comprises a pair of stabiliser legs movable to engage an underlying ground surface. The controller may be further configured to receive a signal representative of the position of the stabiliser legs, and the permissible movement range may be further dependent on said signal.

The permissible movement range may be greater when the stabiliser legs are moved to engage the underlying ground surface than when the stabiliser legs do not engage the underlying ground surface.

A working machine tends to become more laterally stable if it has deployed stabiliser legs. Therefore, the permissible movement range can advantageously be increased when the working machine's stabiliser legs are deployed whilst ensuring that the working machine remains stable.

According to a second aspect of the present teachings, there is provided a control system incorporating a controller according to the first aspect of the teachings.

The control system may further comprise: a load sensor for measuring the stability of the working machine, the load sensor configured to issue the signal representative of the stability of the working machine received by the controller; and/or an angle sensor for measuring an angle of a boom comprised in the load handling apparatus with respect to a horizontal plane of the machine body, the angle sensor configured to issue the signal representative of the position of the load handling apparatus with respect to the machine body received by the controller.

According to a third aspect of the present teachings, there is provided a working machine incorporating a controller according to the first aspect of the present teachings or a control system according to the second aspect of the present teachings. The working machine comprises a machine body and a load handling apparatus coupled to the machine body and moveable by a first movement actuation system with respect to the machine body and moveable by a sway actuator about a sway axis with respect to a reference orientation.

The working machine may further comprise an axle for mounting a ground-engaging structure thereto such as a pair of ground-engaging wheels, the axle being pivotable with respect to the machine body. The sway actuator may be configured to adjust a pivot angle between the axle and the machine body such that the load handling apparatus is moveable about the sway axis.

The working machine may further comprise a further axle for mounting a ground-engaging structure thereto such as a pair of ground-engaging wheels, the further axle being pivotable with respect to the machine body.

The working machine may further comprise a further sway actuator configured to adjust a pivot angle between the further axle and the machine body such that the load handling apparatus is moveable about the sway axis.

The load handling apparatus may comprise a boom.

The working machine may be a telescopic handler, a skid steer loader, or a telescopic wheel loader.

The working machine may further comprise a pair of stabiliser legs movable to engage an underlying ground surface.

According to a fourth aspect of the present teachings, there is provided a method for controlling a working machine comprising a machine body and a load handling apparatus coupled to the machine body and moveable by a first movement actuation system with respect to the machine body and moveable by a sway actuator about a sway axis with respect to a lateral reference orientation. The method comprises the steps of:

receiving a signal representative of the position of the load handling apparatus with respect to the machine body;

receiving a signal representative of a stability of the working machine;

determining a permissible movement range of the load handling apparatus about the sway axis, the permissible movement range being dependent on the signal representative of the position of the load handling apparatus with respect to the machine body and the signal representative of the stability of the machine; and issuing a signal for use by an element of the working machine including the sway actuator, which in response to the issued signal is configured to restrict or prevent movement of the load handling apparatus outside of the permissible movement range relative to the lateral reference orientation.

The load handling apparatus may comprise a boom, and the signal representative of the position of the load handling apparatus with respect to the machine body may correspond to an angle measurement of the boom with respect to a horizontal plane of the machine body.

The method may further comprise the steps of determining a first boom angle and a second boom angle, the first boom angle being lower than the second boom angle, and wherein the permissible movement range may be less at the second boom angle than when the boom is at the first boom angle.

According to a fifth aspect of the present teachings, there is provided a controller for use with a working machine comprising a machine body and a load handling apparatus coupled to the machine body and moveable by a lift actuator with respect to the machine body. The controller is configured to receive: a signal representative of a lateral inclination angle of the machine body with respect to a lateral reference orientation; and a signal representative of a stability of the working machine. The controller is further configured to determine a permissible movement range of the load handling apparatus with respect to the machine body and issue a signal for use by an element of the working machine including the lift actuator, which in response to the signal issued by the controller is configured to restrict or prevent movement of the load handling apparatus outside of the permissible movement range relative to the machine body, the permissible movement range being dependent on the signal representative of a lateral inclination angle of the machine body with respect to a lateral reference orientation and the signal representative of the stability of the machine.

The controller helps to maintain lateral stability of a working machine by limiting movement of the working machine's load handling apparatus with respect to the machine body based on the two signals. Advantageously, the controller may use the two signals to permit a movement range through which the load handling apparatus can move that is considered safe dependent on the state and position of the machine. Thus, the controller may help to increase the allowable safe movement range of the load handling apparatus with respect to the machine body when the working machine is laterally inclined.

The load handling apparatus may comprise a boom, and the permissible movement range of the load handling apparatus with respect to the machine body may correspond to angular positions of the boom with respect to a predetermined plane of the machine body or a longitudinal reference orientation.

The boom may have a fixed orientation relative to the machine body about a vertical axis of the machine body.

The controller may store parameters representative of a first lateral inclination angle and a second lateral inclination angle, the first lateral inclination angle being less than the second lateral inclination angle, and wherein the permissible movement range may be less when the lateral inclination angle of the machine body with respect to the lateral reference orientation corresponds to the second lateral inclination angle than when the lateral inclination angle of the machine body with respect to the lateral reference orientation corresponds to the first lateral inclination angle.

A working machine tends to become more laterally unstable as its lateral inclination angle increases. Therefore, reducing the permissible movement range as the lateral inclination angle increases helps to ensure that the working machine remains stable.

The signal representative of the stability of the working machine may correspond to a longitudinal moment of tilt of the working machine.

The controller may store parameters representative of a first moment of tilt and a second moment of tilt of the working machine, the first moment of tilt being lower than the second moment of tilt, and wherein the permissible movement range may be less when the moment of tilt of the working machine corresponds to the first moment of tilt than when the moment of tilt of the working machine corresponds to the second moment of tilt.

The longitudinal moment of tilt of the working machine may correspond to a load measurement of an axle of the working machine, wherein the axle is for mounting a ground-engaging structure thereto such as a pair of ground-engaging wheels.

The controller may receive the permissible movement range from a predetermined look-up table or map, the predetermined look-up table or map configured to output the permissible movement range that ensures stability of the working machine based on inputs of the lateral inclination angle of the machine body with respect to the lateral reference orientation and the stability of the working machine.

The permissible movement range may be obtained by determining a stability envelope for the working machine and a location of the working machine's centre of gravity. The permissible movement range may be chosen such that the working machine's centre of gravity remains in the stability envelope across the whole of the permissible movement range.

The longitudinal and/or lateral reference orientation may correspond to a horizontal axis defined such that the direction of acceleration due to gravity is normal to the horizontal axis.

The controller may be configured to receive a signal representative of a travelling speed of the working machine, and the permissible movement range may be further dependent on said signal.

The controller may store parameters representative of a first travelling speed and a second travelling speed, the first travelling speed being lower than the second travelling speed, and wherein the permissible movement range may be less at the second travelling speed than at the first travelling speed.

The working machine may further comprises a pair of stabiliser legs movable to engage an underlying ground surface, The controller may be further configured to receive a signal representative of the position of the stabiliser legs, and the permissible movement range may be further dependent on said signal.

The permissible movement range may be greater when the stabiliser legs are moved to engage the underlying ground surface than when the stabiliser legs do not engage the underlying ground surface.

According to a sixth aspect of the present teachings, there is provided a control system incorporating a controller according to the fifth aspect of the present teachings. The control system comprises: a lateral inclination angle sensor configured to issue the signal representative of the lateral inclination angle of the machine body with respect to the lateral reference orientation; and a load sensor for measuring the stability of the working machine, the load sensor configured to issue the signal representative of the stability of the working machine received by the controller.

According to a seventh aspect of the present teachings, there is provided a working machine incorporating a controller according to the fifth aspect of the present teachings or a control system according to the sixth of the present teachings. The working machine comprises a machine body and a load handling apparatus coupled to the machine body and moveable by an actuation system with respect to the machine body.

The load handling apparatus may comprise a boom.

The working machine may be a telescopic handler, a skid steer loader, or a telescopic wheel loader.

The working machine may further comprise a pair of stabiliser legs movable to engage an underlying ground surface.

BRIEF DESCRIPTION OF THE DRAWINGS

Embodiments are now disclosed by way of example only with reference to the drawings, in which.

DETAILED DESCRIPTION OF EMBODIMENT(S)

Figure 1:
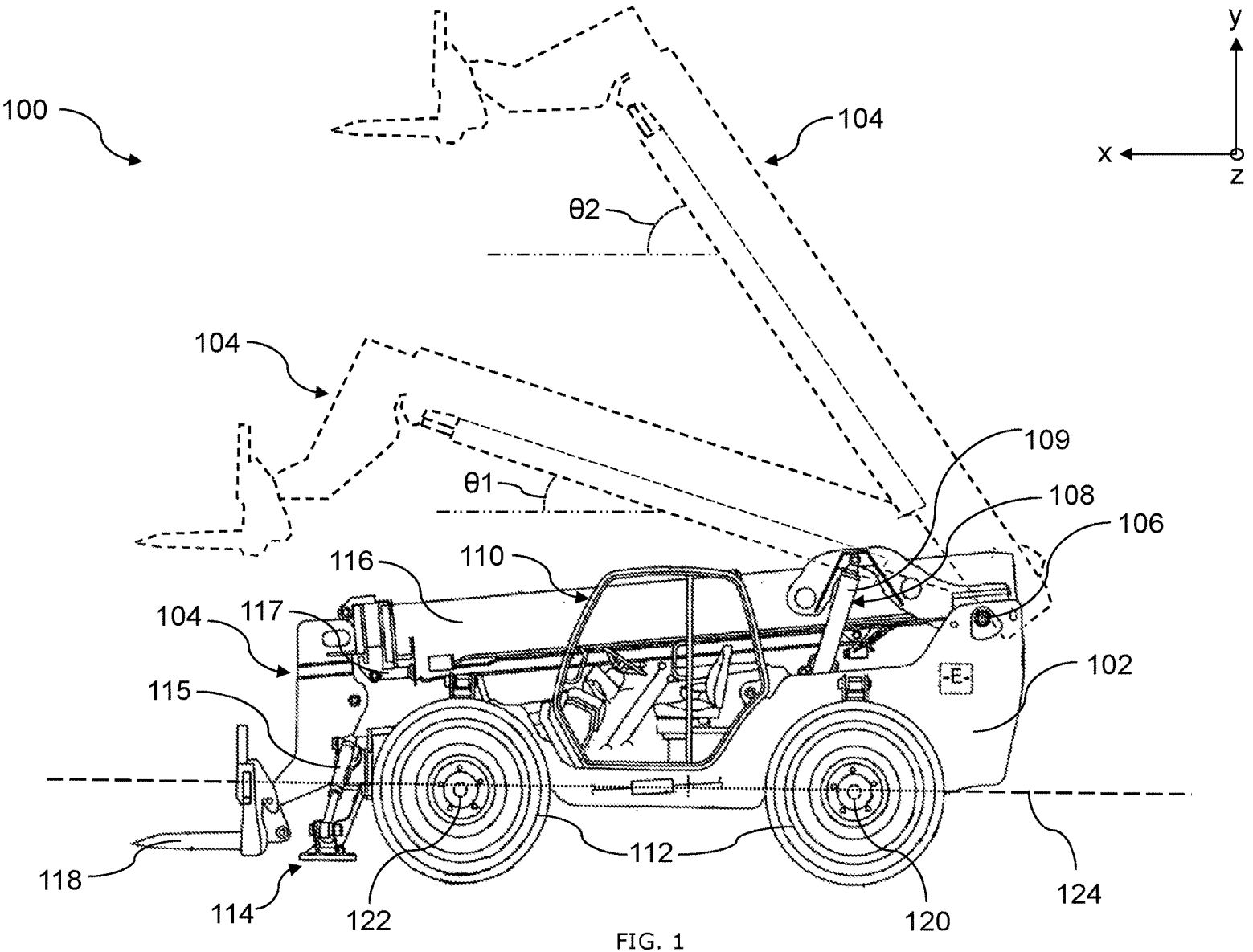
FIG. 1 is a side view of a working machine according to an aspect of the teachings.

FIG. 1 shows a side view of a working machine 100. In particular, the working machine 100 is a telescopic handler. The working machine 100 includes a machine body 102, a load handling apparatus 104 and a cabin 110 within which one or more controls for controlling the working machine 100 and an operator of the working machine 100 may be located.

The load handling apparatus 104 is coupled to the machine body 102 via a pivot 106. The load handling apparatus 104 is able to rotate about the pivot 106 such that the load handling apparatus is movable within the x-y plane shown in FIG. 1. In this embodiment the pivot 106 is located towards a rear of the machine body 102 of the working machine 100

In the illustrated embodiment, the load handling apparatus 104 includes a boom 116 with an implement 118 mounted to a free end thereof. In particular the implement 118 is a pair of forks (only one fork can be seen in FIG. 1). The forks are suited for supporting rigid cargo such as one or more pallets, and may be pivotable about a transverse axis with respect to the boom 116. In this embodiment the implement 118 is located forward of the machine body 102 when the boom 116 is in a lowered position.

The boom 116 is coupled to the machine body 102 via the pivot 106, and is movable about the pivot 106 such that an angle between the boom 116 and a predetermined plane of the machine body 102 (hereinafter referred to as the boom angle) may be altered. This is illustrated in FIG. 1, where the load handling apparatus 104 is shown in phantom for a first boom angle θ1 and a second boom angle θ2. As can be seen in FIG. 1, the first boom angle θ1 is less than the second boom angle θ2.

In the illustrated embodiment, the boom 116 has a fixed orientation relative to the machine body 102 about a vertical axis of the machine body 102; i.e. the boom 116 is constrained such that it cannot pivot about a vertical axis of the machine body 102.

To move the load handling apparatus 104 with respect to the machine body 102, the working machine 100 comprises a lift actuator 108. The lift actuator 108 comprises a pair of hydraulic rams 109 (one visible) which increase the boom angle as the rams 109 extends and reduce the boom angle as the rams 109 retract.

However, in alternative embodiments (not shown), the lift actuator 108 may include only a single hydraulic ram 109.

In the embodiment illustrated in FIG. 1, the boom 116 is telescopic and comprises a telescopic actuator 117 including a hydraulic ram that allows the implement 118 to be positioned remotely with respect to the machine body 102. The boom 116 is shown in its fully retracted position in FIG. 1.

Although not illustrated, the working machine 100 includes a boom angle sensor arrangement for measuring or estimating the boom angle. The boom angle sensor arrangement may be in the form of a potentiometer for example, or any other suitable electronic sensor. In this embodiment the boom angle sensor measures the boom angle relative to the machine body 102 e.g. relative to a predetermined plane such as that defined by the centres of rotation of each of the wheels (see below). In other embodiments the boom angle sensor may measure the angle of the boom relative to a longitudinal reference orientation, for example a longitudinal horizontal axis defined such that the direction of acceleration due to gravity is normal to the longitudinal horizontal axis.

The working machine 100 may also include a boom extension sensor arrangement (not shown) for measuring or estimating the extension of the implement 118 with respect to the machine body 102. The working machine 100 may also or alternatively include a boom retraction switch (not shown) configured to determine whether the boom 116 is fully retracted or not, but which cannot determine the degree of boom extension beyond a fully retracted position.

The working machine 100 comprises a first axle 120 and a second axle 122 that is aligned parallel to the first axle 120. Both axles 120, 122 are not visible in FIG. 1 but are instead represented as dashed circles that indicate their profiles. The machine body 102 is mounted upon both the first axle 120 and the second axle 122.

In the embodiment shown in FIG. 1, the first axle 120 is the rear axle of the working machine 100 and the second axle 122 is the front axle of the working machine 100. However, in alternative embodiments, the first axle 120 may be the front axle and the second axle 122 may be the rear axle of the working machine 100.

A ground-engaging structure 112 is mounted to both the first axle 120 and the second axle 122. In particular, each ground-engaging structure 112 is a pair of ground-engaging wheels where only one wheel of each pair is visible in FIG. 1.

In the illustrated embodiment, a tilt sensing arrangement comprising a load sensor (not shown) is mounted to the first axle 120. In this arrangement, the load sensor is configured to sense a parameter which is representative of a moment of tilt of the machine 100 about a transverse axis of the machine.

In this embodiment the load sensor measures or estimates the load or weight of the working machine 100 which is imparted onto the first axle 120 (referred to as the retained axle load). It will be appreciated that in alternative embodiments such a tilt sensing arrangement may take other forms e.g. may be a strain gauge or pin interposed between the first axle 120 and the machine body 102, or may sense other parameters such as hydraulic pressure in the lift actuator 108, for example.

The load imparted onto the first axle 120 as measured or estimated by the load sensor may be used to determine a moment of tilt of the working machine 100. The moment of tilt is the resultant moment acting on the working machine 100 about an axis parallel to the first and second axles 120, 122 that intersects the centre of gravity of the working machine 100, i.e. a moment within the x-y plane shown in FIG. 1. The moment of tilt is defined as positive in the anti-clockwise direction in FIG. 1.

When the working machine 100 is stable, its centre of gravity is located along the x-direction in FIG. 1. Further, when the stabiliser legs 114 are deployed, the centre of gravity of the working machine 100 is located between the first axle 120 and the stabiliser legs 114, and when the stabiliser legs 114 are not deployed, the centre of gravity of the working machine 100 is located between the first axle 120 and the second axle 122. Therefore, as the moment of tilt increases, the load imparted by the working machine 100 onto the first axle 120 reduces, and vice versa. If the retained load on the first axle 120 reduces to zero, this indicates that the machine 100 is about to tip forward about the second axle 122, or the stabiliser legs 114 if lowered.

It will be appreciated that for a constant boom angle, increasing the load on the implement 118 may increase the moment of tilt and reducing the load on the implement 118 may reduce the moment of tilt. It will also be appreciated that for a constant load on the implement 118, increasing the boom angle may reduce the moment of tilt and reducing the boom angle may increase the moment of tilt.

In the illustrated embodiment, the first axle 120 is an oscillating axle configured to allow the first axle 120 to be pivotable with respect to the machine body 102 about a sway axis 124. The sway axis 124 is perpendicular to both the first axle 120 and the second axle and runs generally through the mid-points of both axles 120, 122; the sway axis 124 being generally aligned with the x-direction in FIG. 1. In FIG. 1, the section of the sway axis 124 that runs through the middle of the working machine 100 is represented as a dotted line in order to indicate that the sway axis 124 is not located to a side of the working machine 100.

The sway axis 124 is generally parallel to a ground plane beneath the working machine 100.

In the illustrated embodiment, a pair of stabiliser legs 114 are mounted in this embodiment to a subassembly that pivots together with the second axle 122 (only one of the stabiliser legs 114 is visible in FIG. 1). Each stabiliser leg 114 is movable to engage a ground surface beneath the working machine 100 during operation. Each stabiliser leg 114 comprises an extendible hydraulic ram 115, the extension of which allows each stabiliser leg 114 to extend from a fully retracted position (not shown) in which each stabiliser leg 114 does not engage the underlying ground surface, to a fully extended position (not shown) in which each stabiliser leg 114 engages an underlying ground surface. In FIG. 1, the stabiliser legs 114 are shown in a partially extended position.

The stabiliser legs 114 increase the forward stability of the working machine 100 by reducing the tipping moment arm length and increasing the moment arm length of the stabilising moment of the mass of the machine. Further if the stabiliser legs are wider than the track of the wheels when lowered, they may also increase the lateral stability of the working machine 100. As such, the stabiliser legs 114 increase the moment thresholds required to tip the working machine 100 over in the forward and lateral directions, i.e. in the x and z directions in FIG. 1.

Although not illustrated, the working machine 100 includes a stabiliser leg sensor arrangement. The stabiliser leg sensor arrangement is configured to provide an output signal that is representative of the position of the stabiliser legs 114. For example, the stabiliser leg sensor arrangement may output a binary signal indicating whether the stabiliser legs 114 are fully deployed. Additionally or alternatively, the stabiliser leg sensor arrangement may measure the pressure in the hydraulic actuators 115 to determine whether or not the stabiliser legs 114 are meeting resistance from engagement with solid underlying ground.

Figure 2:
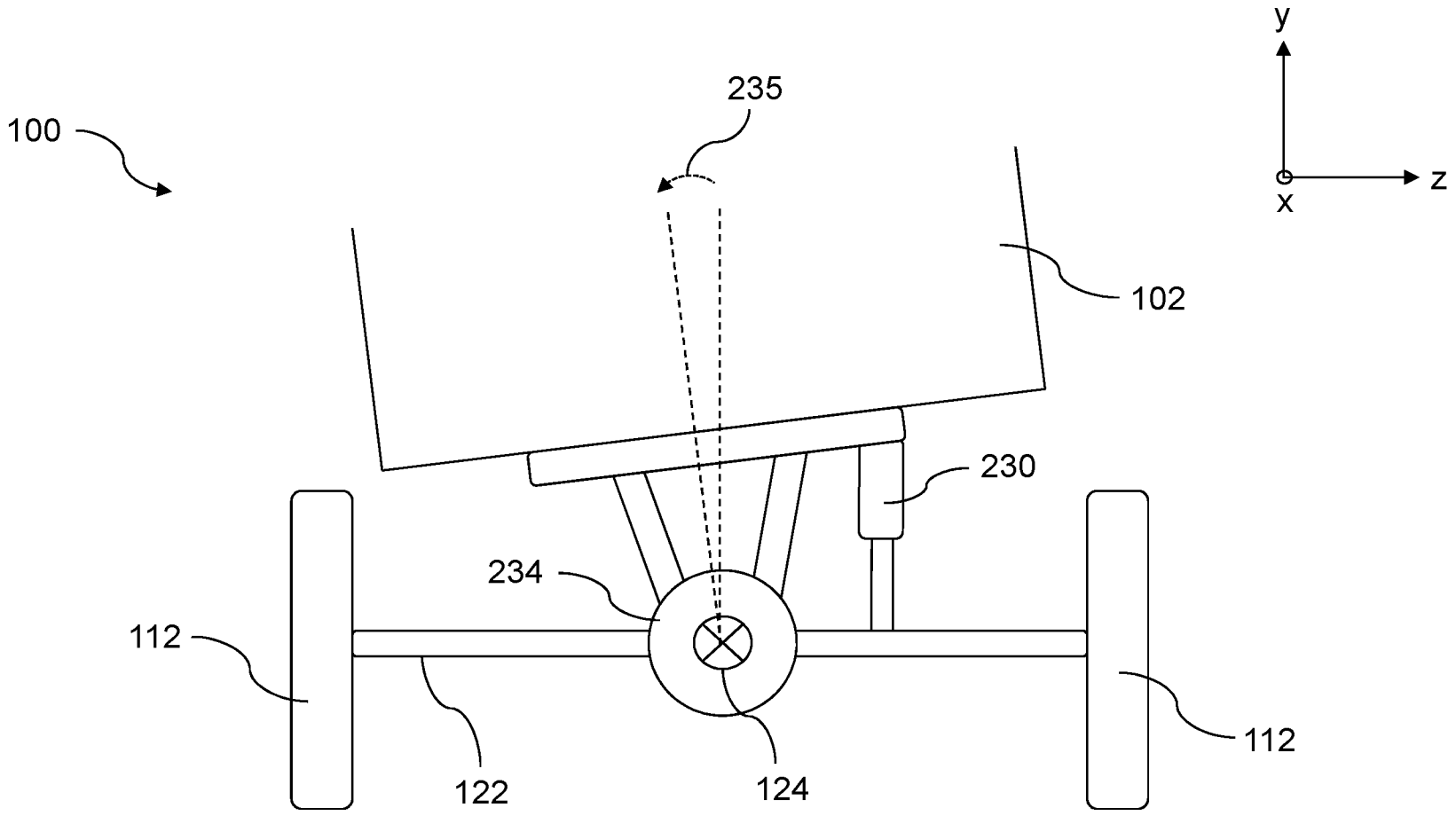
FIG. 2 is a schematic representation of the second axle of the working machine of FIG. 1.

FIG. 2 illustrates schematically the second axle 122 and the location of the sway axis 124 at the mid-point thereof. A sway actuator 230 is interposed between the second axle 122 and the machine body 102. The sway actuator 230 is in this embodiment a linear hydraulic ram. An upper extent of the sway actuator 230 is mounted to the machine body 102 and a lower extent of the sway actuator 230 is mounted to the second axle 122.

The machine body 102 is also mounted to a pivotable joint 234, where the pivotable joint 234 is mounted to the second axle 122. The pivotable joint 234 allows the machine body 102 to pivot with respect to the second axle 122 about the sway axis 124.

The sway actuator 230 is extendible and retractable such that extension of the sway actuator 230 pivots the machine body 102 with respect to the second axle 122 about the sway axis 124 in an anti-clockwise direction indicated by the arrow 235 in FIG. 2. Although not shown, it will be appreciated that retracting the sway actuator 230 would pivot the machine body 102 with respect to the second axle 122 about the sway axis 124 in a clockwise direction in FIG. 2.

Since the first axle 120 is an oscillating axle, pivoting of the machine body 102 with respect to the second axle 122 by the sway actuator 230 will further cause the machine body 102 to pivot with respect to the first axle 120. Therefore, the sway actuator 230 is able to pivot the machine body 102 with respect to both the first axle 120 and the second axle 122 about the sway axis 124.

As the load handling apparatus 104 is coupled to the machine body 102 (see FIG. 1) and is fixed with respect to the machine body 102 in the y-z plane shown in FIG. 2, the sway actuator 230 is also able to move the load handling apparatus 104 with respect to both axles 120, 122 about the sway axis 124.

In alternative embodiments (not shown), the first axle 120 is not a freely oscillating axle and instead has a similar arrangement to the second axle 122 shown in FIG. 2. In such embodiments, a second sway actuator is interposed between the first axle 120 and the machine body 102. The second sway actuator includes a linear hydraulic ram. An upper extent of the actuator is mounted to the machine body 102 and a lower extent of the actuator is mounted to the first axle 120. To pivot the machine body 102 with respect to the first and second axles 120, 122, the first and second sway actuators operate in unison, i.e. the sway actuator 230 and the second sway actuator extend or retract by the same amount.

As previously discussed, the stabiliser legs 114 are mounted to a subassembly that can pivot about a longitudinal axis relative to the machine body 102, and pivots in conjunction with the second axle 122 (not shown in FIG. 2). Hence, the sway actuator 230 is also able to pivot the machine body 102 with respect to the second axle 122 when the stabiliser legs 114 are deployed.

However, in alternative embodiments (not shown), the stabiliser legs 114, when deployed, may be capable of actively pivoting the machine body 102, and therefore the load handling apparatus 104, about the sway axis 124. In such embodiments, the hydraulic actuator used to deploy the stabiliser legs 114 may independently lift the ground engaging structure 112 mounted to the second axle 122 away from the underlying ground surface. The stabiliser legs 114 may then pivot the machine body 102 about the sway axis 124 by extending a first of the stabiliser legs 114 and/or retracting a second of the stabiliser legs 114 to pivot the machine body 102 in a first direction, and by retracting the first of the stabiliser legs 114 and/or extending the second of the stabiliser legs 114 to pivot the machine body 102 in a second opposite direction. As such these hydraulic actuators act as the sway actuator.

In alternative embodiments (not shown), the working machine 100 may include independent active suspension (e.g. air suspension) between one or both axles 120, 122 and the machine body 102. For example, the working machine 100 may include independently extendible and retractable dampers proximate each wheel 112. In such embodiments, the active suspension may be actuated to pivot the machine body 102, and therefore the load handling apparatus 104, about the sway axis 124, without requiring the sway actuator 230.

Figure 3:
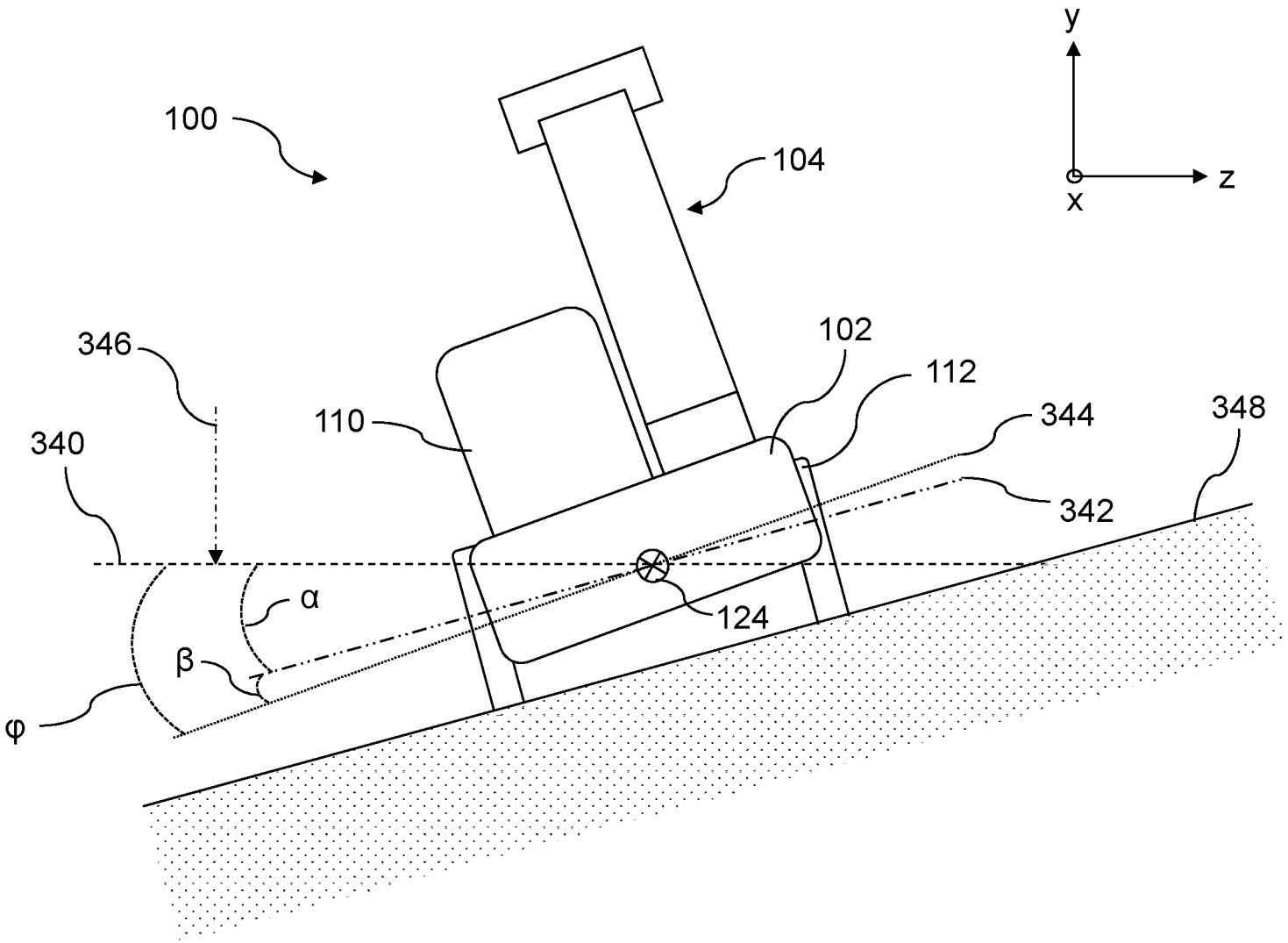
FIG. 3 is a schematic representation of the working machine of FIG. 1 on a ground plane viewed from the rear.

FIG. 3 illustrates schematically the working machine 100 on a ground plane 348. The dash-dot arrow 346 in FIG. 3 represents a gravitational direction; i.e. a direction pointing towards the centre of the earth. Therefore, it can be seen in FIG. 3 that the ground plane 348 defines an incline or slope.

A lateral reference orientation 340 is represented as a dashed line in FIG. 3. The lateral reference orientation 340 is a horizontal plane defined such that gravity 346 is normal to the horizontal plane.

An axle orientation 342 is represented as a dash-dot-dot line in FIG. 3. The axle orientation 342 is parallel to both the first and second axles 120, 122 and intersects the sway axis 124. The axle orientation 342 is substantially parallel to the ground plane 348 beneath the working machine 100.

A machine body orientation 344 is represented as a dotted line in FIG. 3. The machine body orientation 344 is a plane that intersects the sway axis 124, and is fixed to and moves with the machine body 102. The machine body orientation 344 corresponds to a horizontal plane of the machine body 102.

In FIG. 3, the axle orientation 342 is at angle $\alpha$ with respect to the lateral reference orientation 340. Since the ground plane 348 is at an incline, the ground plane angle $\alpha$ is non-zero. The sway actuator 230 has pivoted the machine body 102 with respect to the first and second axles 120, 122 as shown in FIG. 2. Hence, a local sway angle $\beta$ between the machine body orientation 344 and the axle orientation 342 is non-zero. It can be seen in FIG. 3 that a global sway angle $\varphi$ between the machine body orientation 344 and the lateral reference orientation 340 is defined as the sum of the ground plane angle $\alpha$ and the local sway angle $\beta$, i.e. $\varphi=\alpha+\beta$.

Although not illustrated, the working machine 100 may include a local sway angle sensor arrangement for measuring or estimating the local sway angle $\beta$. Such a local sway angle sensor may be in the form of a potentiometer mounted to the pivotable joint 234 for example.

The working machine 100 may also additionally include a ground plane angle sensor arrangement for measuring or estimating the ground plane angle $\alpha$. The ground plane angle sensor may be in the form of a gyroscope mounted to the first axle 120 and/or the second axle 122 for example. Additionally or alternatively, the working machine 100 may include a global sway angle sensor for measuring or estimating the global sway angle $\varphi$. The global sway angle sensor may be in the form of a gyroscope mounted to the machine body 102, the cabin 110 or the load handling apparatus 104 for example.

FIGS. 4*a*-4*f* show schematic representations of the working machine 100 on an inclined ground plane 348. A stability envelope 450 of the working machine 100 is represented as a triangle drawn with a dashed line.

Although shown as a triangle in FIGS. 4*a*-4*f*, in three dimensions, the stability envelope 450 has the shape of a triangular based pyramid since the first axle 120 is free to oscillate. This is illustrated in FIG. 4*g* which shows, schematically, a plan view of the working machine 100 on level ground and its corresponding stability envelope 450. It can be seen that a side of the triangular base of the stability envelope 450 is aligned with the second axle 122, and a vertex of the triangular base of the stability envelope 450 is located at a midpoint of the first axle 120.

In alternative embodiments (not shown), in which the first axle 120 is prevented from swaying, the stability envelope may have the shape of a triangular prism.

The centre of gravity 452 of the working machine 100 is represented as a circle drawn with a dashed line in FIGS. 4*a*-*g*. The working machine 100 is stable when the centre of gravity 452 is located within the stability envelope 450. When the centre of gravity 452 is outside of the stability envelope 450, the working machine 100 is unstable and may tip over onto one of its sides.

The stability envelope 450 for the working machine 100 may be determined via any method known in the art. For example, the stability envelope 450 may be determined via a testing process or via simulation of a computational physics-based model.

The centre of gravity 452 of the working machine 100 is dependent on the mass distribution of the working machine 100. Movement of the load handling apparatus 104 with respect to the machine body 102 may change the location of the centre of gravity 452 with respect to the machine body 102; as will be demonstrated in the following.

Figures 4A, 4B, 4C:
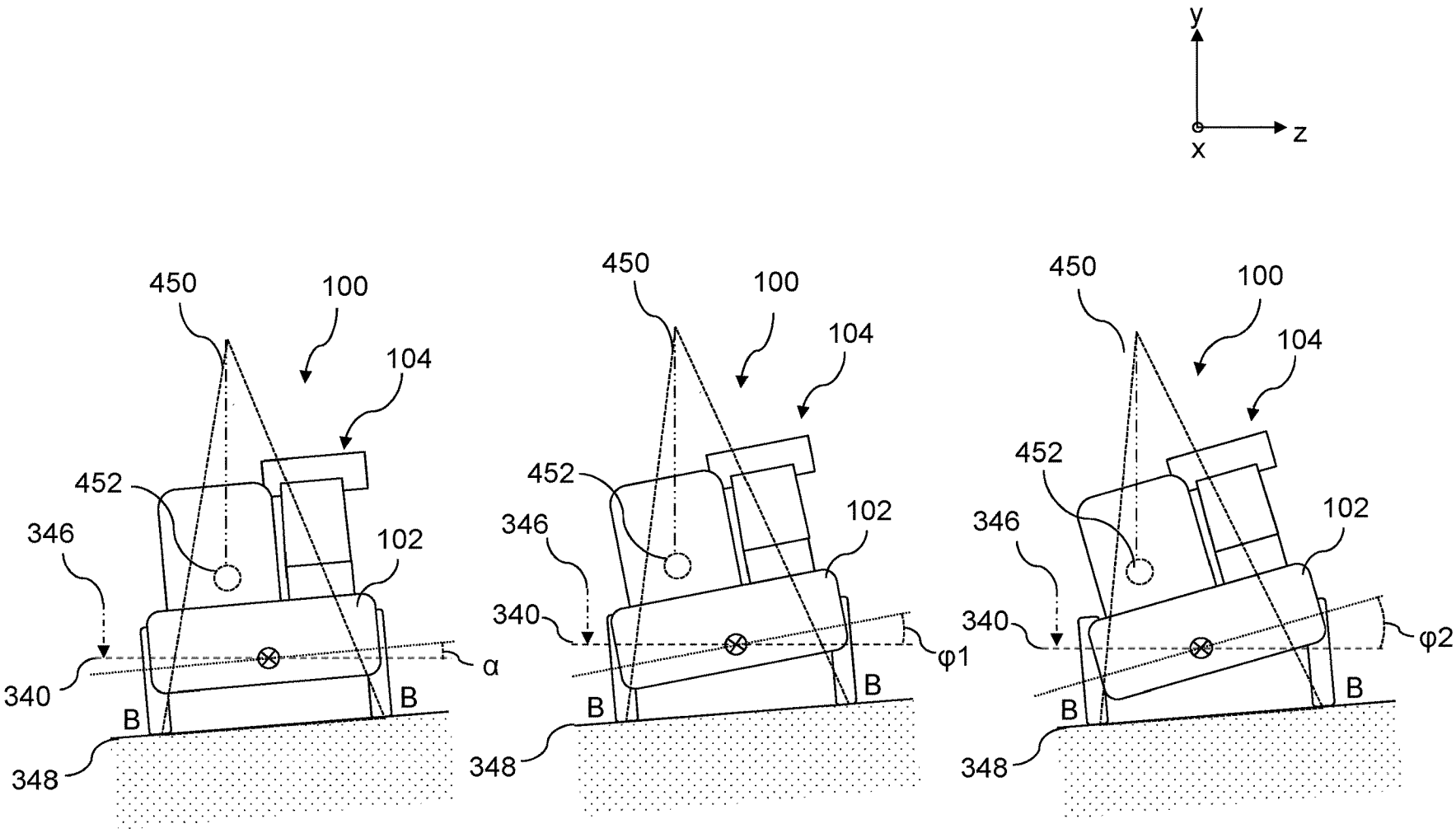
FIGS. 4*a*-4*g* are schematic representations of the working machine of FIG. 1 in different configurations with FIGS. 4*a*-4*c* corresponding to section B-B shown in FIG. 4*g* and FIGS. 4*d*-4*f* corresponding to section A-A shown in FIG. 4*g;*

In FIGS. 4*a*-4*c*, the load handling apparatus 104 is at boom angle $\theta$1, which is shown in phantom in FIG. 1. In FIGS. 4*d*-4*e*, the load handling apparatus 104 is at a boom angle $\theta$2, which is also shown in phantom in FIG. 1. It can be seen from comparison of the figures that the centre of gravity 452 of the working machine 100 is further away from the machine body 102 when the load handling apparatus 104 is at a higher boom angle.

In FIG. 4*g*, a first centre of gravity 452*a* of the working machine 100 corresponds to when the load handling apparatus 104 is at boom angle $\theta$1 and a second centre of gravity 452*b* corresponds to when the load handling apparatus 104 is at boom angle $\theta$2. It can be seen that as the boom angle increases, the location of the centre of gravity 452 of the working machine 100 moves rearward towards the first axle 120. It can also be seen that the base of the stability envelope 450 narrows towards the first axle 120.

FIGS. 4*a*-4*c* correspond to section B-B shown in FIG. 4*g* and FIGS. 4*d*-4*f* correspond to section A-A shown in FIG. 4*g*.

In FIGS. 4*a* and 4*d*, the local sway angle $\beta$ is zero; i.e. the horizontal plane of the machine body 102 is parallel to the first and second axles 120, 122. However, since the working machine 100 is on a ground plane with a non-zero ground plane angle $\alpha$, the global sway angle $\varphi$ is equal to the ground plane angle $\alpha$; i.e. $\varphi=\alpha$.

In both FIGS. 4*a* and 4*d*, the centre of gravity 452 is located within the stability envelope 450. Hence, the working machine 100 is stable for both positions of the load handling apparatus 104 for this global sway angle $\varphi$.

In FIGS. 4*b* and 4*e*, the local sway angle $\beta$ is non-zero. The sway actuator 230 has pivoted the machine body 102 about the sway axis 124 in an anti-clockwise direction relative to FIGS. 4*a* and 4*d*. Accounting for the incline ground plane 348, the global sway angle $\varphi$ of the working machine 100 shown in FIGS. 4*b* and 4*e* is equal to $\varphi$1, which is greater than the ground plane angle $\alpha$; i.e. $\varphi\mathbf{1}>\alpha$.

In both FIGS. 4*b* and 4*e*, the centre of gravity 452 is located within the stability envelope 450. Hence, the working machine 100 is stable in both figures. However, it can be seen that in FIG. 4*e*, the centre of gravity 452 is proximate to the boundary of the stability envelope 450. Hence, relative to the lower boom angle configuration shown in FIG. 4*b*, the higher boom angle configuration shown in FIG. 4*e* is less laterally stable.

Figure 4F:
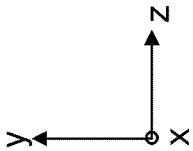
Figure 4F:
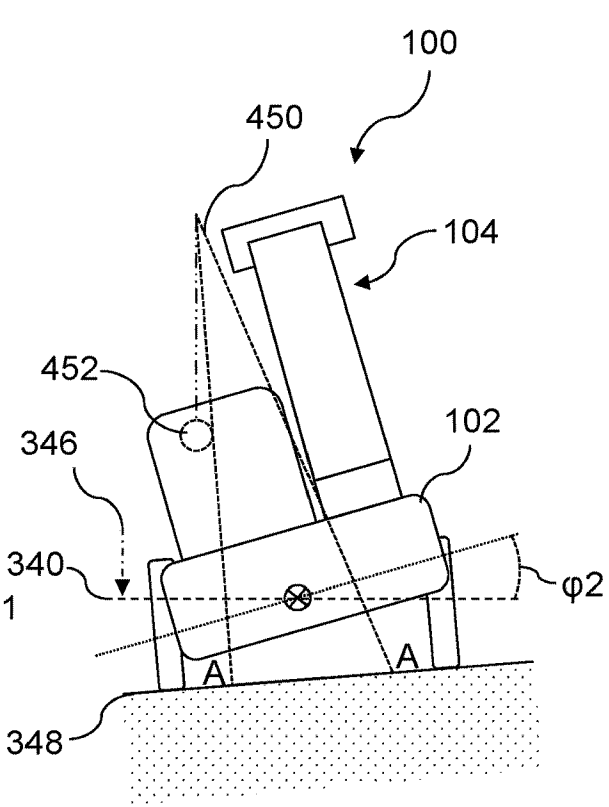
Figure 4E:
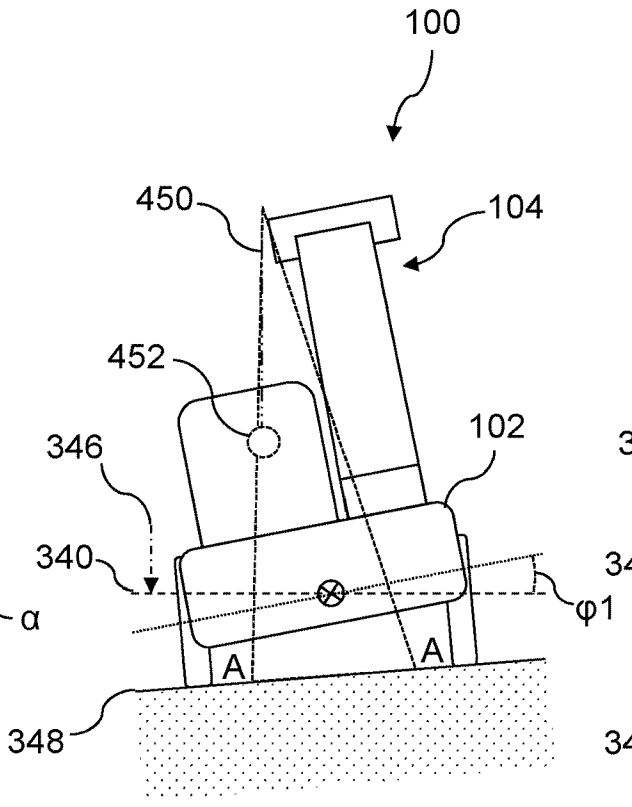
Figure 4D:
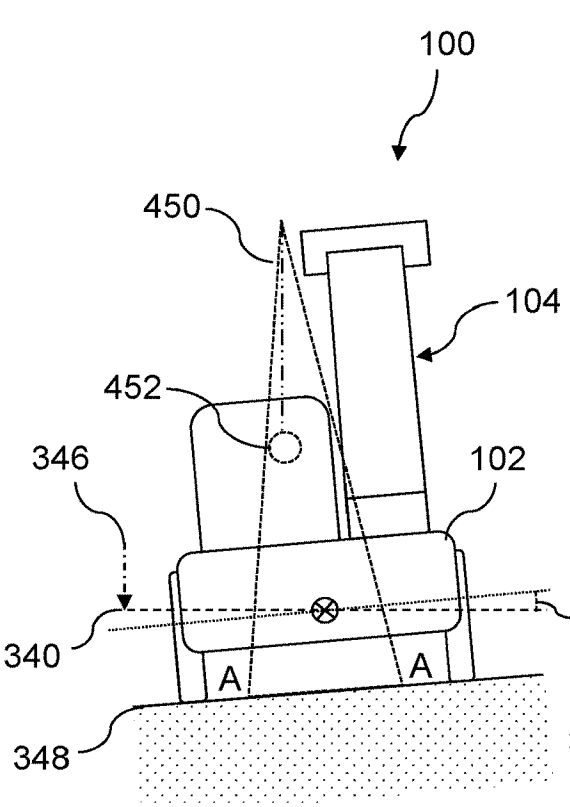
Figure 4G:
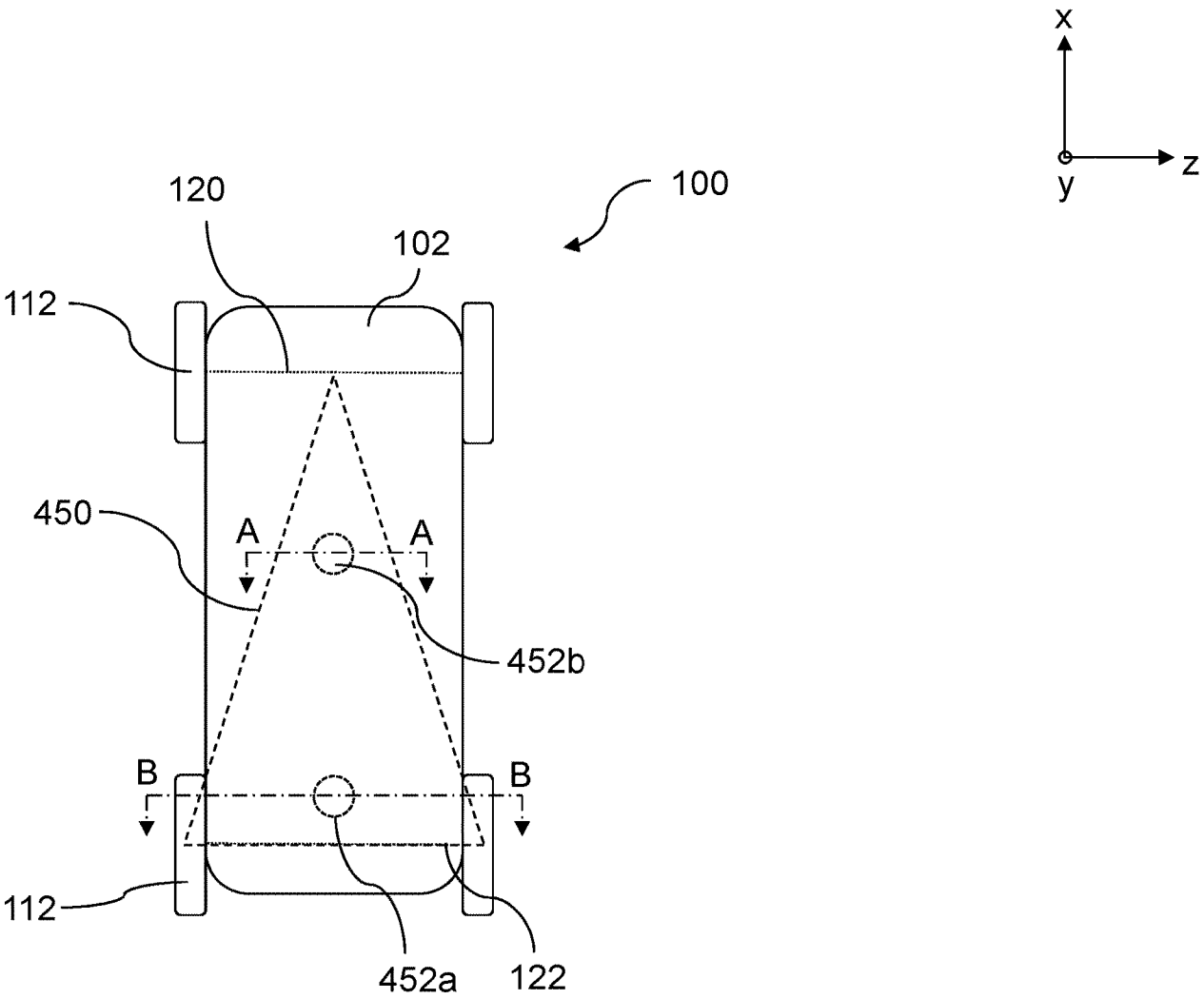

In FIGS. 4*c* and 4*f*, the sway actuator 230 has pivoted the machine body 102 about the sway axis 124 in an anti-clockwise direction relative to FIGS. 4*b* and 4*e*. Hence, the local sway angle $\beta$ is larger in FIGS. 4*c* and 4*f* relative to FIGS. 4*b* and 4*e*. Accounting for the incline ground plane 348, the global sway angle $\varphi$ of the working machine 100 shown in FIGS. 4*c* and 4*f* is equal to $\varphi$2, which is greater than $\varphi$1; i.e. $\varphi\mathbf{2}>\varphi\mathbf{1}$.

In FIG. 4*c*, the centre of gravity 452 is located within the stability envelope 450, and the working machine 100 is therefore stable. In FIG. 4*f*, the centre of gravity 452 is outside of the stability envelope 450. Therefore, in the configuration shown in FIG. 4*f*, the working machine 100 is laterally unstable, and may roll over onto the left-hand-side of the working machine 100 shown in the figure.

It will be appreciated from the foregoing discussion that the position of the load handling apparatus 104 may alter the stability of the working machine 100. It will also be appreciated that the range of global sway angles $\varphi$ within which the working machine 100 remains stable (hereinafter referred to as the permissible movement range) will reduce as the load handling apparatus 104 is positioned so as to increase the distance between the centre of gravity 452 and the machine body 102. In particular, the permissible movement range will reduce as the boom angle of the boom 116 increases.

Figure 5:
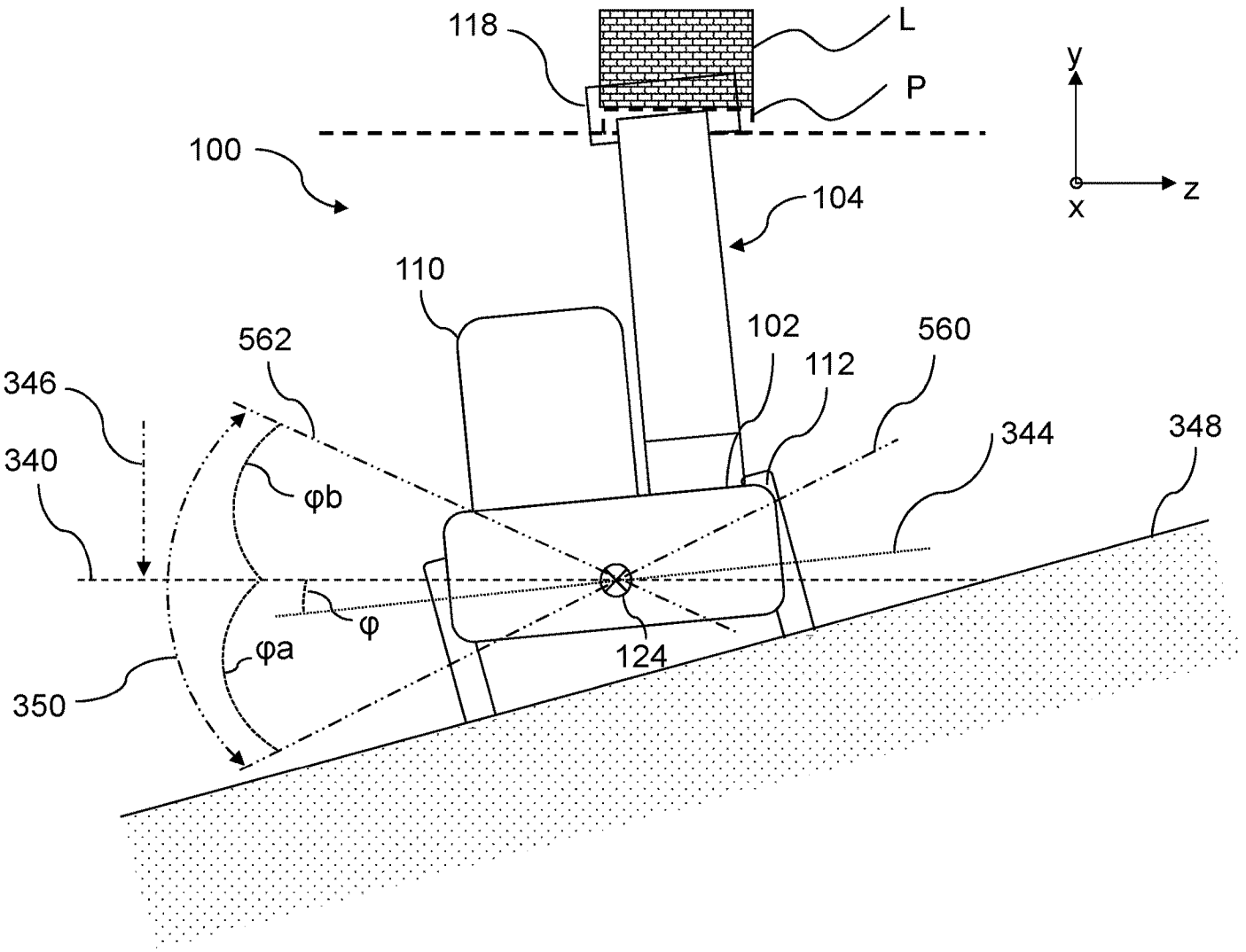
FIG. 5 is a schematic representation of the working machine of FIG. 1 viewed from the rear on a ground plane.

FIG. 5 shows the working machine 100 as shown in FIG. 3, where the machine body 102 is at a global sway angle $\varphi$ about the sway axis 124 with respect to the lateral reference orientation 340.

A first stability boundary 560 is represented as a dash-dot-dot line in FIG. 5, and is at an angle $\varphi$a to the lateral reference orientation 340. A second stability boundary 562 is also represented as a dash-dot-dot line in FIG. 5, and is at an angle $\varphi$b to the lateral reference orientation.

The centre of gravity 452 of the working machine 100 is within the stability envelope 450 when the machine body orientation 344 is between the first stability boundary 560 and the second stability boundary; i.e. the global sway angle φ of the working machine 100 is within the permissible movement range [φa, φb] 350. Therefore, the working machine 100 is stable when the global sway angle φ of the working machine 100 is within the permissible movement range 350.

The centre of gravity 452 of the working machine 100 is outside of the stability envelope 450 when the global sway angle φ of the working machine 100 is outside of the permissible movement range 350. Therefore, the working machine 100 is unstable when the global sway angle φ of the working machine 100 is outside of the permissible movement range 350.

It can be seen that in FIG. 5 the machine body 102 is not aligned with the lateral reference orientation 340 and consequently the implement 118 (pallet forks) is not aligned with a pallet P carrying a load L that is resting on an elevated, but horizontal surface. As such the pallet forks cannot engage with the pallet P to lift the load L.

It can also be seen in FIG. 5 that the working machine 100 is on an incline. Relative to the incline, the permissible movement range 350 indicates that the machine body 102 and the load handling apparatus 104 can safely pivot about the sway axis 124 to a far greater extent towards the top of the incline than towards the bottom of the incline.

Figure 6:
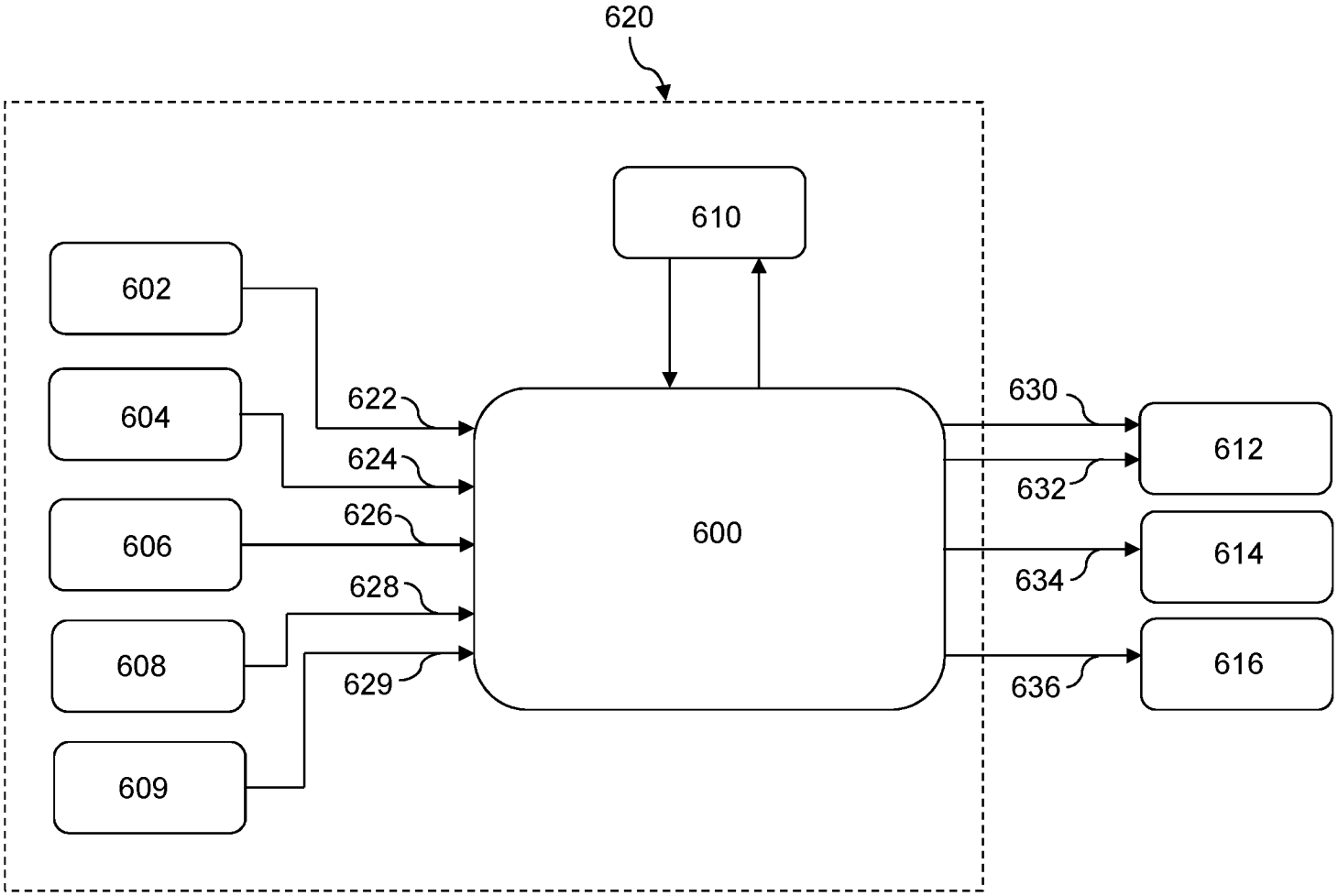
FIG. 6 is a diagram of a controller according to an aspect of the teachings and a control system according to an aspect of the teachings.

FIG. 6 shows a schematic representation of a controller 600 for use with the working machine 100. The controller 600 is configured to receive a first input signal 622 representative of the position of the load handling apparatus 104 with respect to the machine body 102 from a first sensor arrangement 602. The controller 600 is also configured to receive a second input signal 624 representative of the stability of the working machine 100 from a second sensor arrangement 604.

In the illustrated embodiment, the first input signal 622 corresponds to a measurement of the angle between the boom 116 and a horizontal plane of the machine body 102; i.e. the boom angle. The first sensor arrangement 602 includes the boom angle sensor.

In alternative embodiments, it will be appreciated that the first input signal 622 may correspond to the telescopic extension of the boom 116, or an articulation angle of a backhoe for example.

In the illustrated embodiment, the second input signal 624 corresponds to the moment of tilt of the working machine 100. The moment of tilt of the working machine 100 is determined from a measurement of the load imparted on the first axle 120 by the working machine 100. The second sensor arrangement 604 therefore includes the load sensor.

Additionally or alternatively, the second input signal 624 may correspond to a cylinder pressure in the sway actuator 230 as measured by a pressure sensor. The cylinder pressure may indicate the load imparted by the working machine 100 on the second axle 122, and therefore may be used to determine the moment of tilt of the working machine 100.

The controller 600 may also be configured to receive a third input signal 626 representative of a travelling speed of the working machine 100 from a third sensor arrangement 606. The third sensor arrangement 606 may include a speedometer and/or a GPS device for example.

The controller 600 may also be configured to receive a fourth input signal 628 representative of the position of the stabiliser legs 114 from a fourth sensor arrangement 608. The fourth sensor arrangement 608 may correspond to the stabiliser leg sensor arrangement.

The controller 600 may also be configured to receive a fifth signal 629 representative of the local sway angle β from a fifth sensor arrangement 609. The fifth sensor arrangement 609 may include the local sway angle sensor, which may be in the form of a potentiometer mounted to the pivotable joint 234.

Alternatively, the fifth signal 629 may be representative of the global sway angle φ, and the fifth sensor arrangement 609 may include the global sway angle sensor, which may be in the form of a gyroscope mounted to the machine body 102, the cabin 110 or the load handling apparatus 104. The controller 600 is configured to determine the permissible movement range 350 of the machine body 102, and therefore the load handling apparatus 104, about the sway axis 124. The permissible movement range 350 is determined by the controller 600 such that it is dependent on the first input signal 622 and the second input signal 624.

The controller 600 may receive the permissible movement range 350 from a predetermined look-up table or map 610. The predetermined look-up table or map 610 is configured to output the permissible movement range 350 to the controller 600 based at least on inputs of the position of the load handling apparatus 104 with respect to the machine body 102 (as represented by the first input signal 622) and the stability of the working machine 100 (as represented by the second input signal 624).

The predetermined look-up table or map 610 is generated by determining the stability envelope 450 and the centre of gravity 452 of the working machine 100 for all combinations of the inputs to the predetermined look-up table or map 610. The permissible movement range 350 is then determined for each combination of the inputs, where the permissible movement range is chosen such that the centre of gravity 452 remains in the stability envelope 450 across the whole of the permissible movement range 350.

Although the predetermined look-up table or map 610 is shown as being separate to the controller 600 in FIG. 6, it will be appreciated that the predetermined look-up table or map 610 may be stored in a memory within the controller 600.

With reference to FIGS. 1 and 6, the controller 600 may store parameters representative of the first boom angle θ1 and the second boom angle θ2, where the first boom angle θ1 is less than the second boom angle θ2. The permissible movement range 350 determined by the controller 600 may be less when the boom 116 is at the second boom angle θ2 than when the boom 116 is at the first boom angle θ1 as the working machine 100 typically becomes less laterally stable as the boom angle increases.

The controller 600 may store parameters of a first moment of tilt and a second moment of tilt of the working machine 100, the first moment of tilt being lower than the second moment of tilt. The permissible movement range 350 determined by the controller 600 may be less when the moment of tilt of the working machine 100 corresponds to the first moment of tilt than when the moment of tilt of the working machine 100 corresponds to the second moment of tilt.

For machines where the sway actuator 230 is provided on the second (front) axle 122, the rear axle 120 may sway freely, and the load handling apparatus 104 extends forward of the front axle it has been found that the stability envelope 450 of the working machine 100 increases in size as the moment of tilt increases, and therefore as the load imparted onto the first axle 120 by the working machine 100 reduces.

Therefore, the working machine 100 becomes more laterally stable as the moment of tilt increases.

The permissible movement range 350 determined by the controller 600 may be partially dependent on the third input signal 626 representative of the travelling speed of the working machine 100. For example, the look-up table or map 610 may receive the travelling speed of the working machine 100 as an input. The permissible movement range 350 provided by the look-up table or map 610 may be partly based on the travelling speed of the working machine 100.

The controller 600 may store parameters representative of a first travelling speed and a second travelling speed, the first travelling speed being lower than the second travelling speed. The permissible movement range 350 determined by the controller 600 may be less when the working machine 100 is travelling at the second travelling speed than at the first travelling speed.

The risk of unsafe changes in stability being caused by dynamic effects increases at higher speeds e.g. when driving over uneven ground at higher speeds, lateral swaying will occur at a greater rate and inertial effects are therefore more likely to cause a machine 100 to tip sideways.

The permissible movement range 350 determined by the controller 600 may be partially dependent on the fourth input signal 628 representative of the position of the stabiliser legs 114. For example, the look-up table or map 610 may receive the position of the stabiliser legs 114 as an input. The permissible movement range 350 provided by the look-up table or map 610 may be partly based on the position of the stabiliser legs 114.

The permissible movement range 350 may be greater when the fourth input signal 628 indicates that the stabiliser legs 114 are engaging the underlying ground surface than when the fourth input signal 628 indicates that stabiliser legs 114 are not engaging the underlying ground surface.

Deployment of the stabiliser legs 114 that are wider than the track of the machine 100 increases the lateral stability of the working machine 100. Therefore, it is recognised for the permissible movement range 350 to increase when the stabiliser legs 114 are deployed to engage the underlying ground surface relative to when they are not so deployed. As the stabiliser legs are mounted to the machine body and when deployed lift the front of the machine off the ground, adjustment of the lengths of the stabiliser leg actuators should occur to effect adjustment of sway rather that adjusting the sway actuator.

The permissible movement range 350 determined by the controller 600 may be partially dependent on one or more additional input signals (not shown in FIG. 6). For example, the controller 600 may receive an input signal indicative of whether or not the load handling apparatus 104 is carrying a load suspended from the implement 118 via a non-rigid rope, chain or cable. Since such a load may swing relative to the load handling apparatus 104, and may therefore dynamically alter the centre of gravity 452 of the working machine 100, the controller 600 may reduce the permissible movement range 350 by a predetermined amount as a safety precaution when it is notified that the load handling apparatus 104 is carrying a suspended load.

The controller 600 is further configured to issue a first output signal 630 for use by an element 612 of the working machine 100. The element 612 includes the sway actuator 230. In response to the first output signal 630, the element 612 is configured to restrict or prevent movement of the machine body 102, and therefore the load handling apparatus 104, outside of the permissible movement range 350 relative to the lateral reference orientation 340.

For example, the first output signal 630 may correspond to the permissible movement range 350, and the element 612 may include a separate controller that controls the sway actuator 230 such that the machine body 102 and load handling apparatus 104 can only sway within the permissible movement range 350.

Alternatively, the controller 600 may control the sway actuator 230 directly. The controller 600 may receive commands from the operator of the working machine 100 to change the local sway angle β, and only allow the working machine 100 to sway within the permissible movement range 350.

In some embodiments, in response to the first output signal 630 issued by the controller 600, the element 612 of the working machine 100 including the sway actuator 230 is configured to implement an upper speed limit such that the machine body 102, and therefore the load handling apparatus 104, is prevented from moving at rotational speeds higher than the upper speed limit about the sway axis 124.

For example, when the permissible movement range 350 is relatively large, it may be safe to allow the working machine 100 to change its local sway angle β at a relatively high rate. On the other hand, when the permissible movement range 350 is relatively small, it may only be safe to allow the working machine 100 to change its local sway angle β at a relatively low rate. This may be achieved by using a two stage switchable damper in the hydraulic flow to the sway actuator 230, or by making the service fully proportional, e.g. by use of a proportional solenoid valve.

The controller 600 may be configured to issue a second output signal 632 for use by the element 612. In response to the second output signal 632, the element 612, which includes the sway actuator 230, is configured to move the machine body 102, and therefore the load handling apparatus 104, about the sway axis 124 to a desired position within the permissible movement range 350.

In such embodiments, the controller 600 may receive an input from an operator of the working machine 100 to manually adjust the sway angle at a particular rate. If the controller 600 determines that the desired sway angle is within the permissible movement range 350, but the range is relatively narrow, the controller 600 may then issue the second output signal 632 instructing the element 612 to move the machine body 102 and load handling apparatus 104 at a rate lower than the desired sway angle.

The element 612 may include a local sway angle sensor in a feedback arrangement to ensure that the machine body 102 and load handling apparatus 104 are moved to the desired sway angle.

In some embodiments, the sway adjustment may be automated, e.g. the operator instructs the machine body 102 to adopt a particular orientation, such as an orientation in parallel to the lateral reference orientation 340 (i.e. normal to gravity) and the controller issues a signal to adjust the sway actuator at a rate that is appropriate to the prevailing stability conditions.

Thus the machine operator in the situation described in relation to FIG. 5 may provide an input to instruct the machine body and therefore the load handling apparatus 104 to adopt an orientation parallel to the lateral reference orientation 340. As this lies within the permissible movement range 350, the controller instructs the sway actuator to adjust. This causes the machine body 102 to adopt the lateral reference orientation, and, as a result, the load handling apparatus is aligned with the pallet P and can therefore lift the load L.

The controller 600 may be configured to issue a third output signal 634 for use by an operator interface 614. The operator interface 614 may be a display located in the cabin 110 which is visible to the operator of the working machine 100. Additionally or alternatively, the operator interface 614 may be an audible alert played within the cabin 110 which is audible to the operator of the working machine 100.

In response to the third output signal 634, the operator interface 614 is configured to provide an indication of the permissible movement range 350. For example, the operator interface 614 may indicate the actual permissible movement range 350. Alternatively, the operator interface 614 may only indicate whether or not it is permitted for the working machine 100 to alter its local sway angle β.

The controller 600 may be configured to issue a fourth output signal 636 for use by a load handling apparatus actuation system 616. The load handling apparatus actuation system 616 includes the lift actuator 108 and may include the telescopic actuator 117 of the load handling apparatus 104. In response to the fourth output signal 636, the load handling apparatus actuation system 616 is configured to restrict or prevent movement of the load handling apparatus 104 (e.g. a change of boom angle or boom extension) when such movement would result in the working machine 100 becoming unstable. The controller 600 may receive information from the predetermined look-up table or map 610 in order to determine when movement of the load handling apparatus 104 needs to be prevented or restricted in order to ensure stability of the working machine 100.

In alternative embodiments (not shown), the working machine 100 may include a jib or an auxiliary with a winch attachment mounted to the boom 116. In such embodiments, the load handling apparatus actuation system 616 may include an actuator configured to tilt the jib or the auxiliary relative to the boom 116. In response to the fourth output signal 636, the load handling apparatus actuation system 616 may be configured to restrict or prevent movement of the jib or the auxiliary (e.g. a change of tilt angle of the jib or the auxiliary relative to the boom 116) when such movement would result in the working machine 100 becoming unstable.

A control system 620 is represented as a box drawn with a dashed line in FIG. 6. The control system 620 incorporates the controller 600. The control system 620 may also include one or more of the first sensor arrangement 602, the second sensor arrangement 604, the third sensor arrangement 606, the fourth sensor arrangement 608 and the fifth sensor arrangement 609.

The table below sets out an example of the sway angles and speeds that can permitted by the controller 600 dependent upon boom angle as an indication of the position of the load handling apparatus, and rear (first) axle load as an indication of stability.

| Boom Angle | Retained Rear Axle Load | Permissible Sway Angle | Sway adjustment Speed |
|---|---|---|---|
| Low | Low | +/−7° | Fast |
| Medium | Low | +/−5° | Fast |
| High | Low | +/−1° | Slow |
| Low | Medium | +/−7° | Fast |
| Medium | Medium | +/−3° | Slow |
| High | Medium | 0 | n/a |
| Low | High | +/−7° | Slow |
| Medium | High | +/−2° | Slow |
| High | High | 0 | n/a |

Even with the limited number of permutations set out in the table, it will be appreciated that the productivity of the machine 100 is significantly improved compared with the prior art. In other embodiments, it should be appreciated that a greater number of permutations of the parameters above may be used, and/or values may be selected by interpolating between the parameters.

Further it should be appreciated that the greater productivity is achieved without the addition of appreciable cost, since the sensors and actuators required are typically present on telescopic handlers and similar machines to be compliant with safety legislation for longitudinal stability.

It will be appreciated from the foregoing discussion, that the position of the load handling apparatus with respect to the machine body 102 can affect the lateral stability of the working machine 100.

For example, when the working machine 100 is located on an inclined slope, such that the lateral inclination angle of the working machine 100 is non-zero, movement of the load handling apparatus 104 away from the machine body (e.g. increasing the boom angle) may result in the working machine 100 becoming laterally unstable. By lateral inclination angle of the working machine 100, it is meant an angle between a transverse horizontal axis of the machine body 102 and the lateral reference orientation 340.

Figure 8:
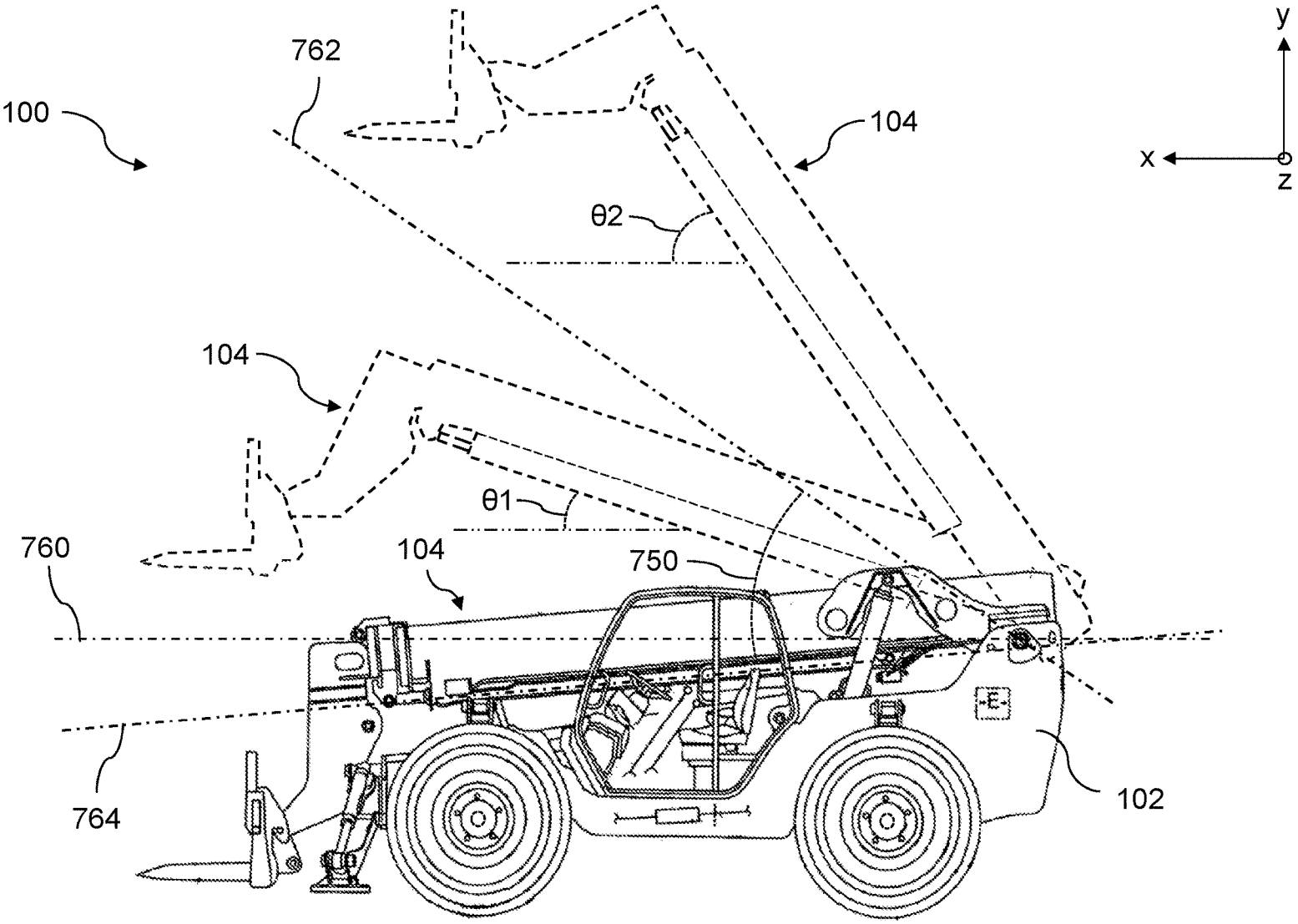
FIG. 8 is an annotated version of FIG. 1.

FIG. 8 shows the working machine 100 as shown in FIG. 1 with several of the reference numerals removed for clarity.

FIG. 8 shows the load handling apparatus 104 in three configurations: i) fully lowered; ii) at boom angle θ1; and iii) at boom angle θ2. Although not clear in FIG. 8, the working machine 100 is located on an inclined slope such that the machine body 102 is orientated at a significant non-zero lateral inclination angle.

Also shown in FIG. 8 is a horizontal plane 760 of the machine body 102, a stability boundary 762 and a machine boundary 764.

The stability boundary 762 represents the maximum boom angle relative to the horizontal plane 760 at which the working machine 100 remains laterally stable. If the boom angle is increased beyond the stability boundary 762, the centre of gravity 452 of the working machine 100 moves outside of the stability envelope 450, and the working machine 100 becomes laterally unstable; a comparison of FIGS. 4*c* and 4*f* shows an example of this phenomenon.

The machine boundary 764 represents the position of the load handling apparatus 104 when it cannot be lowered anymore due to abutment with the machine body 102 or with stops located on the working machine 100.

A permissible movement range 750 represents the range of movement of the load handling apparatus within which the working machine 100 remains stable.

In the illustrated embodiment, the permissible movement range corresponds to a set of angular positions of the boom 116 with respect to the horizontal plane 760 within which the working machine 100 remains stable.

The permissible movement range 750 is defined by the stability boundary 762 and the machine boundary 764. When the load handling apparatus 104 is located outside of the permissible movement range 750, i.e. at a higher boom angle than the stability boundary 762, the working machine 100 may become laterally unstable.

For example, as shown in FIG. 8, when the load handling apparatus 104 is orientated at boom angle θ2, the load handling apparatus 104 is outside of the permissible movement range 750. Hence, the working machine 100 may become laterally unstable in this configuration.

When the load handling apparatus 104 is orientated at boom angle 81, the load handling apparatus 104 is within the permissible movement range 750. Hence, the working machine 100 is stable in this configuration.

It will be appreciated that a working machine including a load handling apparatus but that does not include any form of sway actuator (not shown) will still have a permissible movement range 750 as described.

Figure 7:
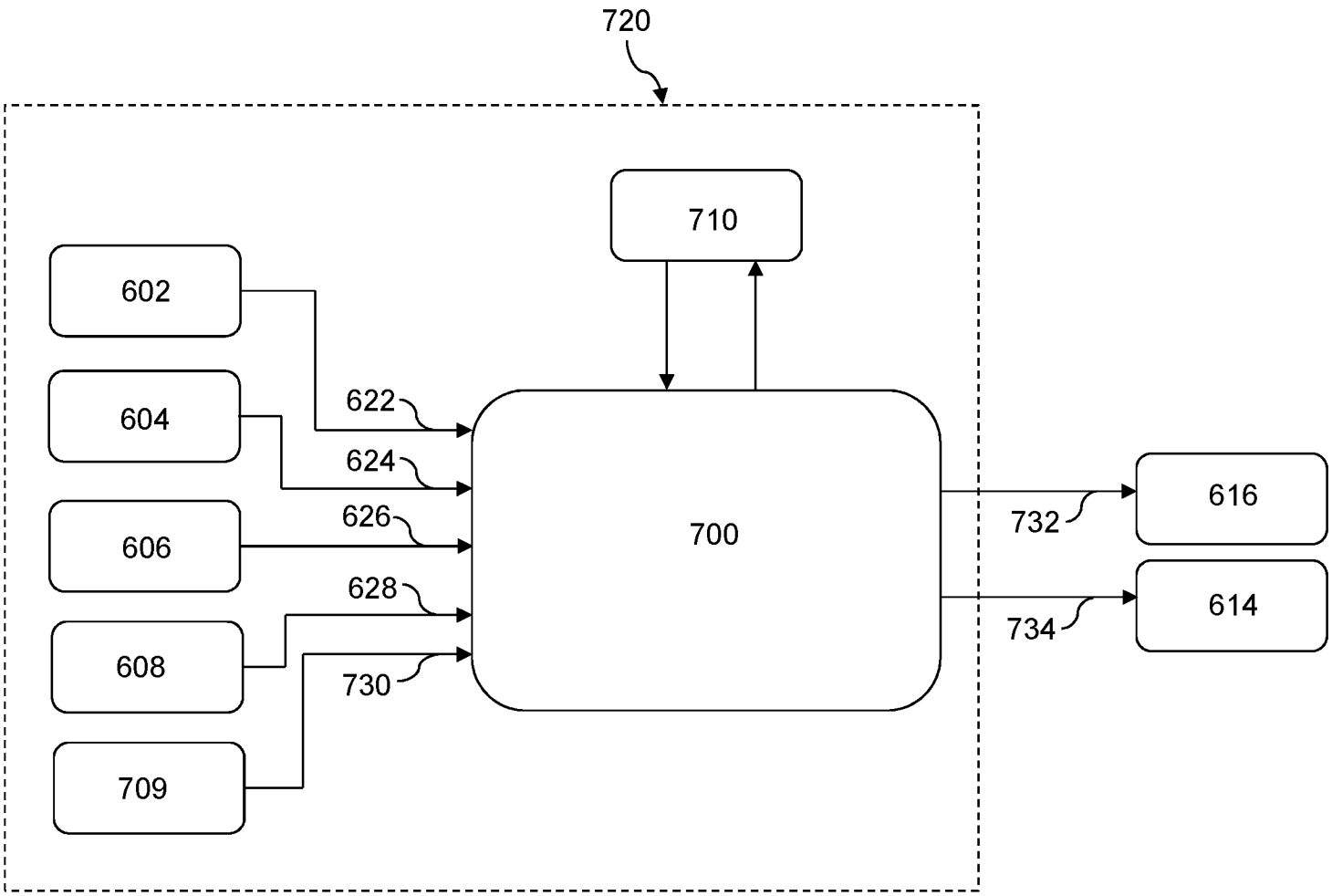
FIG. 7 is a diagram of a controller according to an aspect of the teachings and a control system according to an aspect of the teachings.

FIG. 7 shows a schematic representation of a controller 700 for use with the working machine 100. The controller 700 is also suitable for use with a working machine comprising a machine body 102 and a load handling apparatus 104 that is not swayable, i.e. not comprising a sway actuator 230 (not shown).

The controller 700 shares a number of features that are common with the controller 600. Hence, identical reference numerals indicate common features between the two controllers 600, 700. A discussion of common features will not be repeated for brevity.

The controller 700 may be configured to receive the first input signal 622 representative of the position of the load handling apparatus 104 with respect to the machine body 102 from the first sensor arrangement 602.

The controller 700 is configured to receive the second input signal 624 representative of the stability of the working machine 100 from the second sensor arrangement 604.

The controller 700 may also be configured to receive the third input signal 626 representative of the travelling speed of the working machine 100 from the third sensor arrangement 606. The third sensor arrangement 606 may include a sensor monitoring the motion of a component in the driveline of the machine e.g. rotation of a driveshaft or gear and/or a GPS device or ground radar device, for example.

The controller 700 may also be configured to receive the fourth input signal 628 representative of the position of the stabiliser legs 114 from the fourth sensor arrangement 608. The fourth sensor arrangement 608 may correspond to the stabiliser leg sensor arrangement.

The controller 700 is configured to receive a fifth input signal 730 representative of the lateral inclination angle of the machine body 102 with respect to the lateral reference orientation 340 from a fifth sensor arrangement 709.

In the illustrated embodiment, the fifth input signal 730 corresponds to the global sway angle $\varphi$ between the machine body orientation 344 and the lateral reference orientation 340 (see FIG. 3). For non-swayable working machines, the fifth input signal 730 may be substantially equal to the ground plane angle $\alpha$ between the axle orientation 342 and the lateral reference orientation 340.

The fifth sensor arrangement 709 includes a lateral inclination sensor such as a gyroscope mounted to the machine body 102.

The controller 700 may receive a permissible movement range 750 from a predetermined look-up table or map 710. The predetermined look-up table or map 710 is configured to output the permissible movement range 750 to the controller 700 based at least on inputs of the lateral inclination angle of the machine body 102 with respect to the lateral reference orientation 340 (as represented by the fifth input signal 730) and the stability of the working machine 100 (as represented by the second input signal 624).

The predetermined look-up table or map 710 is generated by determining the stability envelope 450 and the centre of gravity 452 of the working machine 100 for all combinations of the inputs to the predetermined look-up table or map 710. The permissible movement range 750 is then determined for each combination of the inputs, where the permissible movement range 750 is chosen such that the centre of gravity 452 remains in the stability envelope 450 across the whole of the permissible movement range 750.

Although the predetermined look-up table or map 710 is shown as being separate to the controller 700 in FIG. 7, it will be appreciated that the predetermined look-up table or map 710 may be stored in a memory within the controller 700.

The controller 700 may store parameters of a first lateral inclination angle and a second lateral inclination angle of the working machine 100, the first lateral inclination angle being less than the second lateral inclination angle. The permissible movement range 750 determined by the controller 700 may be less when the lateral inclination angle of the working machine 100 corresponds to the second lateral inclination angle than when the lateral inclination angle of the working machine 100 corresponds to the first lateral inclination angle.

It will be appreciated that as the lateral inclination angle of the working machine 100 increases, the working machine's centre of gravity 452 will move towards the stability envelope 450 of the working machine 100, as shown in FIGS. 4*a*-4*c*. Hence, the working machine 100 will become more laterally unstable as the lateral inclination angle of the working machine 100 increases.

The controller 700 may store parameters of a first moment of tilt and a second moment of tilt of the working machine 100, the first moment of tilt being lower than the second moment of tilt. The permissible movement range 750 determined by the controller 700 may be less when the moment of tilt of the working machine 100 corresponds to the first moment of tilt than when the moment of tilt of the working machine 100 corresponds to the second moment of tilt.

For machines where the sway actuator 230 is provided on the second (front) axle 122, the rear axle 120 may sway freely, and the load handling apparatus 104 extends forward of the front axle it has been found that the stability envelope 450 of the working machine 100 increases in size as the moment of tilt increases, and therefore as the load imparted onto the first axle 120 by the working machine 100 reduces. Therefore, the working machine 100 becomes more laterally stable as the moment of tilt increases. This also applies to working machines without a sway actuator and comprising an oscillating rear axle (not shown). However, the situation would be reversed for machines with a freely oscillating front axle and a fixed rear axle or an axle whose position is controllable by a sway actuator.

The permissible movement range 750 determined by the controller 700 may be partially dependent on the third input signal 626 representative of the travelling speed of the working machine 100. For example, the look-up table or map 710 may receive the travelling speed of the working machine 100 as an input. The permissible movement range 750 provided by the look-up table or map 710 may be partly based on the travelling speed of the working machine 100.

The controller 700 may store parameters representative of a first travelling speed and a second travelling speed, the first travelling speed being lower than the second travelling speed. The permissible movement range 750 determined by the controller 700 may be less when the working machine 100 is travelling at the second travelling speed than at the first travelling speed.

The risk of unsafe changes in stability being caused by dynamic effects increases at higher speeds e.g. when driving over uneven ground at higher speeds, lateral swaying will occur at a greater rate and inertial effects are therefore more likely to cause a machine 100 to tip sideways.

The permissible movement range 750 determined by the controller 700 may be partially dependent on the fourth input signal 628 representative of the position of the stabiliser legs 114. For example, the look-up table or map 710 may receive the position of the stabiliser legs 114 as an input. The permissible movement range 750 provided by the look-up table or map 710 may be partly based on the position of the stabiliser legs 114.

The permissible movement range 750 may be greater when the fourth input signal 628 indicates that the stabiliser legs 114 are engaging the underlying ground surface than when the fourth input signal 628 indicates that stabiliser legs 114 are not engaging the underlying ground surface.

Deployment of the stabiliser legs 114 that are wider than the track of the machine 100 increases the lateral stability of the working machine 100. Therefore, it is recognised for the permissible movement range 750 to increase when the stabiliser legs 114 are deployed to engage the underlying ground surface relative to when they are not so deployed.

The permissible movement range 750 determined by the controller 700 may be partially dependent on one or more additional input signals (not shown in FIG. 7). For example, the controller 700 may receive an input signal indicative of whether or not the load handling apparatus 104 is carrying a load suspended from the implement 118 via a non-rigid rope, chain or cable. Since such a load may swing relative to the load handling apparatus 104, and may therefore dynamically alter the centre of gravity 452 of the working machine 100, the controller 600 may reduce the permissible movement range 750 by a predetermined amount as a safety precaution when it is notified that the load handling apparatus 104 is carrying a suspended load.

The controller 700 is configured to issue a first output signal 732 for use by the load handling apparatus actuation system 616. The load handling apparatus actuation system 616 includes the lift actuator 108 and may include the telescopic actuator 117 of the load handling apparatus 104.

In response to the first output signal 732, the load handling apparatus actuation system 616 is configured to restrict or prevent movement of the load handling apparatus 104 outside of the permissible movement range 750 relative to the machine body 102.

In alternative embodiments (not shown), the working machine 100 may include a implements such as a winch attachment or a jib with or without a winch mounted to the boom 116. The jib may be fixed or extendable by an actuator driven by an auxiliary hydraulic or electrical service of the machine. In such embodiments, the load handling apparatus actuation system 616 may include an actuator configured to tilt the jib relative to the boom 116 and/or a valve/switch to control operation of the auxiliary service. In response to the first output signal 732, the load handling apparatus actuation system 616 may be configured to restrict or prevent movement of the jib or the auxiliary service (e.g. a change of tilt angle or extension of the jib relative to the boom 116) when such movement would result in the working machine 100 becoming unstable.

The controller 700 may be configured to issue a second output signal 734 for use by the operator interface 614.

In response to the second output signal 734, the operator interface 614 is configured to provide an indication of the permissible movement range 750. For example, the operator interface 614 may indicate the actual permissible movement range 750. Alternatively, the operator interface 614 may only indicate whether or not it is permitted for the load handling apparatus 104 to change its boom angle.

A control system 720 is represented as a box drawn with a dashed line in FIG. 7. The control system 720 incorporates the controller 700. The control system 720 may also include one or more of the first sensor arrangement 602, the second sensor arrangement 604, the third sensor arrangement 606, the fourth sensor arrangement 608 and the fifth sensor arrangement 709.

The invention claimed is:

1. A controller for use with a working machine comprising a machine body and a load handling apparatus coupled to the machine body and moveable by a lift actuator with respect to the machine body and moveable by a sway actuator about a sway axis with respect to a lateral reference orientation, wherein the controller is configured to receive:

a signal representative of the position of the load handling apparatus with respect to the machine body or a longitudinal reference orientation; and a signal representative of a stability of the working machine, and wherein the controller is further configured to determine a permissible movement range of the load handling apparatus about the sway axis and issue a signal for use by an element of the working machine including the sway actuator, which in response to the signal issued by the controller is configured to restrict or prevent movement of the load handling apparatus outside of the permissible movement range relative to the lateral reference orientation, the permissible movement range being dependent on the signal representative of the position of the load handling apparatus with respect to the machine body or longitudinal reference orientation and the signal representative of the stability of the machine.

2. The controller of claim 1, wherein the load handling apparatus comprises a boom, and wherein the signal representative of the position of the load handling apparatus with respect to the machine body corresponds to an angle measurement of the boom with respect to a horizontal plane of the machine body or longitudinal reference orientation and optionally, wherein the controller stores parameters representative of a first boom angle and a second boom angle, the first boom angle being lower than the second boom angle, and wherein the permissible movement range is less at the second boom angle than when the boom is at the first boom angle.

3. The controller of claim 1, wherein the signal representative of the stability of the working machine corresponds to a longitudinal moment of tilt of the working machine, and optionally, wherein the controller stores parameters representative of a first moment of tilt and a second moment of tilt of the working machine, the first moment of tilt being lower than the second moment of tilt, and wherein the permissible movement range is less when the moment of tilt of the working machine corresponds to the first moment of tilt than when the moment of tilt of the working machine corresponds to the second moment of tilt.

4. The controller of claim 3, wherein the longitudinal moment of tilt of the working machine corresponds to a load measurement of an axle of the working machine, wherein the axle is for mounting a ground-engaging structure thereto such as a pair of ground-engaging wheels.

5. The controller of claim 1, wherein the controller receives the permissible movement range from a predetermined look-up table or map, the predetermined look-up table or map configured to output the permissible movement range that ensures stability of the working machine based on inputs of the position of the load handling apparatus with respect to the machine body and the stability of the working machine.

6. The controller of claim 1, wherein the permissible movement range is obtained by determining a stability envelope for the working machine and a location of the working machine's centre of gravity, and wherein the permissible movement range is chosen such that the working machine's centre of gravity remains in the stability envelope across the whole of the permissible movement range.

7. The controller of claim 1, wherein the lateral reference orientation and/or longitudinal reference orientation corresponds to a horizontal axis defined such that the direction of acceleration due to gravity is normal to the horizontal axis.

8. The controller of claim 1, wherein the sway axis is parallel to a ground plane beneath the working machine during operation.

9. The controller of claim 1, wherein in response to the signal issued by the controller, the element of the working machine is configured to implement an upper speed limit such that the load handling apparatus is prevented from moving at rotational speeds higher than the upper speed limit about the sway axis.

10. The controller of claim 1, wherein the controller is configured to receive a signal representative of a travelling speed of the working machine, and wherein the permissible movement range is further dependent on said signal, and optionally, wherein the controller stores parameters representative of a first travelling speed and a second travelling speed, the first travelling speed being lower than the second travelling speed, and wherein the permissible movement range is less at the second travelling speed than at the first travelling speed.

11. The controller of claim 1, wherein the controller is further configured to issue a signal for use by an operator interface such as a display or an audible alert, which in response to said signal is configured to provide an indication of the permissible movement range.

12. The controller of claim 1, wherein the controller is further configured to issue a signal for use by the element of the working machine, which in response to said signal is configured to move the load handling apparatus about the swivel axis to a desired position within the permissible movement range.

13. The controller of claim 1, wherein the working machine further comprises a pair of stabiliser legs movable to engage an underlying ground surface, and wherein the controller is further configured to receive a signal representative of the position of the stabiliser legs, the permissible movement range being further dependent on said signal, and optionally, wherein the permissible movement range is greater when the stabiliser legs are moved to engage the underlying ground surface than when the stabiliser legs do not engage the underlying ground surface.

14. A method for controlling a working machine comprising a machine body and a load handling apparatus coupled to the machine body and moveable by a first movement actuation system with respect to the machine body and moveable by a sway actuator about a sway axis with respect to a lateral reference orientation, the method comprising the steps of:

receiving a signal representative of the position of the load handling apparatus with respect to the machine body or a longitudinal reference orientation;

receiving a signal representative of a stability of the working machine;

determining a permissible movement range of the load handling apparatus about the sway axis, the permissible movement range being dependent on the signal representative of the position of the load handling apparatus with respect to the machine body or longitudinal reference orientation and the signal representative of the stability of the machine; and issuing a signal for use by an element of the working machine including the sway actuator, which in response to the issued signal is configured to restrict or prevent movement of the load handling apparatus outside of the permissible movement range relative to the lateral reference orientation.

15. The method of claim 14, wherein the load handling apparatus comprises a boom, and wherein the signal representative of the position of the load handling apparatus with respect to the machine body corresponds to an angle measurement of the boom with respect to a predetermined plane of the machine body or longitudinal reference orientation, and optionally, wherein the method further comprises the steps of determining a first boom angle and a second boom angle, the first boom angle being lower than the second boom angle, and wherein the permissible movement range is less at the second boom angle than when the boom is at the first boom angle.

16. A controller for use with a working machine comprising a machine body and a load handling apparatus coupled to the machine body and moveable by a lift actuator with respect to the machine body, wherein the controller is configured to receive:

a signal representative of a lateral inclination angle of the machine body with respect to a lateral reference orientation; and a signal representative of a stability of the working machine, and wherein the controller is further configured to determine a permissible movement range of the load handling apparatus with respect to the machine body or a longitudinal reference orientation and issue a signal for use by an element of the working machine including the lift actuator, which in response to the signal issued by the controller is configured to restrict or prevent movement of the load handling apparatus outside of the permissible movement range relative to the machine body or longitudinal reference orientation, the permissible movement range being dependent on the signal representative of a lateral inclination angle of the machine body with respect to a lateral reference orientation and the signal representative of the stability of the machine.

17. The controller of claim 16, wherein the load handling apparatus comprises a boom, and wherein the permissible movement range of the load handling apparatus with respect to the machine body corresponds to angular positions of the boom with respect to a predetermined plane of the machine body or the longitudinal reference orientation, and optionally, wherein the boom has a fixed orientation relative to the machine body about a vertical axis of the machine body.

18. The controller of claim 16, wherein the controller stores parameters representative of a first lateral inclination angle and a second lateral inclination angle, the first lateral inclination angle being less than the second lateral inclination angle, and wherein the permissible movement range is less when the lateral inclination angle of the machine body with respect to the lateral reference orientation corresponds to the second lateral inclination angle than when the lateral inclination angle of the machine body with respect to the lateral reference orientation corresponds to the first lateral inclination angle.

19. The controller of claim 16, wherein the signal representative of the stability of the working machine corresponds to a longitudinal moment of tilt of the working machine, and optionally, wherein the controller stores parameters representative of a first moment of tilt and a second moment of tilt of the working machine, the first moment of tilt being lower than the second moment of tilt, and wherein the permissible movement range is less when the moment of tilt of the working machine corresponds to the first moment of tilt than when the moment of tilt of the working machine corresponds to the second moment of tilt.

20. The controller of claim 19, wherein the longitudinal moment of tilt of the working machine corresponds to a load measurement of an axle of the working machine, wherein the axle is for mounting a ground-engaging structure thereto such as a pair of ground-engaging wheels.

21. The controller of claim 16, wherein the controller receives the permissible movement range from a predetermined look-up table or map, the predetermined look-up table or map configured to output the permissible movement range that ensures stability of the working machine based on inputs of the lateral inclination angle of the machine body with respect to the lateral reference orientation and the stability of the working machine.

22. The controller of claim 16, wherein the permissible movement range is obtained by determining a stability envelope for the working machine and a location of the working machine's centre of gravity, and wherein the permissible movement range is chosen such that the working machine's centre of gravity remains in the stability envelope across the whole of the permissible movement range.

23. The controller of claim 16, wherein the lateral reference orientation and/or longitudinal reference orientation corresponds to a horizontal axis defined such that the direction of acceleration due to gravity is normal to the horizontal axis.

24. The controller of claim 16, wherein the controller is configured to receive a signal representative of a travelling speed of the working machine, and wherein the permissible movement range is further dependent on said signal, and optionally, wherein the controller stores parameters representative of a first travelling speed and a second travelling speed, the first travelling speed being lower than the second travelling speed, and wherein the permissible movement range is less at the second travelling speed than at the first travelling speed.

25. The controller of claim 16, wherein the working machine further comprises a pair of stabiliser legs movable to engage an underlying ground surface, and wherein the controller is further configured to receive a signal representative of the position of the stabiliser legs, the permissible movement range being further dependent on said signal, and optionally, wherein the permissible movement range is greater when the stabiliser legs are moved to engage the underlying ground surface than when the stabiliser legs do not engage the underlying ground surface.

* * * * *